United States Patent [19]

Miles et al.

[11] Patent Number: 4,936,206

[45] Date of Patent: Jun. 26, 1990

[54] HIGH-DENSITY COMPACTOR FOR FIBROUS MATERIAL

[75] Inventors: Thomas R. Miles, 5475 SW. Arrowwood La., Portland, Oreg. 97225; Eric U. Doiron, Rusticoville, Canada

[73] Assignee: Thomas R. Miles, Portland, Oreg.

[21] Appl. No.: 289,468

[22] Filed: Dec. 30, 1988

[51] Int. Cl.[5] ..... B65B 13/02; B30B 9/30

[52] U.S. Cl. ..... 100/3; 100/7; 100/17; 100/188 R; 100/215; 100/218; 100/219; 100/232; 100/244; 100/269 R

[58] Field of Search ..... 100/3, 4, 7, 17, 35, 100/42, 179, 188 R, 215, 218, 219, 232, 244, 245, 264, 269 R

[56] References Cited

U.S. PATENT DOCUMENTS

| | | | |
|---|---|---|---|
| 2,876,696 | 3/1959 | White | 100/3 X |
| 3,089,410 | 5/1963 | Stangl . | |
| 3,266,096 | 8/1966 | Thomas et al. . | |
| 3,451,190 | 6/1969 | Tezuka . | |
| 3,528,364 | 9/1970 | Freund | 100/219 X |
| 3,996,849 | 12/1976 | Del Jiacco . | |
| 4,090,440 | 5/1978 | Jensen | 100/188 R X |
| 4,150,613 | 4/1979 | Smee et al. | 100/218 X |
| 4,483,245 | 11/1984 | Fetters . | |
| 4,676,153 | 6/1987 | Ast . | |
| 4,718,335 | 1/1988 | Ast . | |

FOREIGN PATENT DOCUMENTS

| | | | |
|---|---|---|---|
| 1447550 | 6/1966 | France | 100/244 |
| 1480396 | 4/1967 | France | 100/244 |
| 617285 | 7/1978 | U.S.S.R. | 100/244 |
| 965906 | 8/1964 | United Kingdom | 100/3 |

*Primary Examiner*—Philip R. Coe
*Assistant Examiner*—Stephen F. Gerrity
*Attorney, Agent, or Firm*—Klarquist, Sparkman, Campbell, Leigh & Whinston

[57] ABSTRACT

A method and apparatus for compressing fibrous material into dense bales having uniform size, shape and weight. Weighed longitudinally extended charges of material having a predetermined transverse dimensional profile are individually loaded into a compression chamber defined by side plates and first and second movable end platens. A long-stroke small-diameter hydraulic piston pushes the first end platen against the charge toward the second end platen, partially compressing the charge. The first end platen is then latched in a fixed position at full stroke while the second end platen, via a short-stroke large-diameter hydraulic piston, applies a further compressive force to the charge against the first end platen. The resulting fully compressed charge is pushed out of the compression chamber, bound loosely while still fully compressed, then released, whereupon the bale longitudinally expands into the bindings to a predetermined length. As the large-diameter piston retracts to begin the subsequent compression cycle, hydraulic oil is routed therefrom to other hydraulic cylinders to effect retraction thereof, thereby lessening demand on the hydraulic pump, saving energy and reducing cycle time.

30 Claims, 14 Drawing Sheets

HIGH-DENSITY COMPACTOR FOR FIBROUS MATERIAL

FIELD OF THE INVENTION

The present invention relates generally to the compaction of fibrous material into dense bales. More particularly, it relates to a method and apparatus for axially compressing a low-density, longitudinally extended mound of coarse, fibrous material, such as straw or hay, into high-density bales of uniform size, shape, and weight to reduce volume-based costs of storage and shipping.

BACKGROUND OF THE INVENTION

For shipping and storage, many types of fibrous material can be pressed and bound into bales. Such bales usually have a particular size and shape, depending upon the type and characteristics of the material in the bale and the type of baling machine used. Substantially uniform bales, particularly those having square or rectangular profiles, are advantageous because they usually require no packaging material other than wire, twine, or strapping to hold the bale together and because they can be tightly stacked with minimal space between bales.

A bale of fibrous material may be of relatively low density for any of various reasons. First, the material may contain moisture; a dense bale may not allow material in the interior of the bale to aerate properly, which may cause rotting. Second, an overly dense bale may damage the fibers, especially if they are not oriented properly relative to the compression and binding. Third, dense bales may be too heavy for a person to handle without equipment. Fourth, some materials may be extremely resistant to compaction, resulting in recoil forces on the bindings that exceed the strength of the binding materials. Fifth, material compressed too tightly may become too difficult to separate later when the bale is opened.

However, it is often desirable to bale fibrous material in the densest bale practicable because storage and shipping costs based on volume rather than weight will be lower with denser bales. If the particular material will permit, recompressing low-density bales into high-density bales especially for long-distance shipping may appreciably lower shipping costs, which will make the product more price-competitive in its destination market.

Mown and dried herbaceous forage for livestock is commonly baled for shipping and storage. Hay (alfalfa, timothy, grass, clover, etc.) and straw (stalks of wheat, oats, grass, etc.) are customarily bound in the field into several different types and sizes of bale, in both cylindrical (round bales) and rectangular solid shapes ("rectangular" and "square" bales) having a density of approximately six to ten pounds per cubic foot or less.

Round bales of forage are typically large in diameter (six feet or more) and very low in density. Their size and shape make them difficult to store and transport economically. Consequently, they are usually used only on the farm where the forage was grown, obviating the need for further compression.

Rectangular or square bales of forage are available in a variety of sizes including: 14"×18" bales in 3- and 4-foot lengths, 16"×18" bales in 3- and 4-foot lengths, 17"×23"×4', 4'×4'×8', and 3 178 '×4'×8'. The 14"×18" and 16"×18" sizes are the most common. Because rectangular or square bales can be closely stacked, they are the preferred shapes for storing and shipping. However, shipping such bales is usually limited by the space on the transporting vehicle or in the shipping container, which typically can be loaded with more weight than that obtained when the container is fully loaded with low-density field bales.

For example, a typical 40-foot long shipping container has a volume of approximately 2,000 cubic feet and a load limit of 30 tons, or 30 pounds per cubic foot. The minimal current cost is approximately $1,000 to ship a 40-foot container across the Pacific Ocean. If such a container were loaded with hay bales having a density of 10 pounds per cubic foot, the approximate maximum field bale density, the net weight would only be 10 tons, and the shipping cost would be $100 per ton. Costs would be even higher for bales having a density of less than 10 pounds per cubic foot. In other words, because typical field bales are not sufficiently dense to make weight in overseas shipping containers, hay grown domestically and sold overseas is unduly expensive. If bales could be compressed to a mean density of at least 20 pounds per cubic foot, the shipping costs would be reduced to $50 per ton or less.

Increasing the density of bales would also permit more forage to be stored in a given area or volume of space which would tend to decrease storage costs.

There are several problems associated with forming such dense bales, especially of hay or straw. First, dried stems of grasses and other herbaceous forage are mechanically strong and resist compaction. During a typical field baling operation, the stems are usually laid flat and "stacked" inside a rectangular or square bale as a number of transversely oriented layers or "wafers" in a longitudinally extended bale. Because stems of grass or straw are hollow cylinders, which are mechanically very strong structures, a large number of tightly packed stems oriented parallel to the longitudinal axis of the bale would be extremely difficult to compress longitudinally, requiring prohibitively high applied forces. As a result, significant compaction of dried forage is practical only along the longitudinal axis of the bale, where the compaction force is substantially transverse to the axis of the stems. Even so, large magnitude forces are required to achieve bale densities greater than 20 pounds per cubic foot. Extremely large forces are required to achieve densities of 30 pounds per cubic foot or greater.

Second, grass stems are hollow and contain air that can be difficult to expel quickly during compaction. Such trapped air may only slowly be released after extreme compression of the stems, which can cause large post-compaction recoil forces to be exerted on bale bindings at the moment the bale is released from the compaction apparatus, causing the binding material to fail at unacceptably high rates. Such recoil forces are also the result of the mechanical resiliency of forage stems to compaction. Some manufacturers have attempted to solve that problem by using metal wire or metal strapping to bind bales. Unfortunately, however, metal binding material can cause serious injury or death to livestock if ingested.

Third, individual condensed bales should be kept small to limit bale weight so that individual bales can be manually handled without undue difficulty.

Fourth, longitudinal compaction of a hay bale to high density requires an extremely large-magnitude force but only near the end of the compaction stroke. During such a longitudinal compression stroke, the magnitude of force necessary to overcome resistance and achieve a progressively greater bale density increases approximately exponentially relative to a linear increase in density. Likewise, as a bale is longitudinally compressed, the magnitude of force necessary to achieve a progressively shorter bale also increases approximately exponentially relative to a linear decrease in length. If a single hydraulic cylinder were used to perform the entire compaction stroke, the cylinder would have to be sufficiently large in diameter to generate the maximum compression force required at the end of stroke. It would also need to have a long stroke to traverse the long, relatively low-compression portion of the resistance curve. Such large-diameter-long-stroke cylinders, however, require much larger volumes of oil to move the piston a given distance compared to smaller diameter, less powerful cylinders. Pumping such large volumes within acceptable time periods requires large capacity pumps and correspondingly powerful pump-drive motors. Because a compaction apparatus needs to generate high forces only during the last few inches toward maximum stroke, single-cylinder compactors are inherently wasteful of energy; large volumes of oil must be pumped quickly to move a large diameter piston over a long stroke distance over most of which high compression power is not needed. Compaction costs, including energy costs, should be kept as low as possible to ensure that preshipment compression of bales is economically attractive.

Fifth, compression should only be applied along a single axis to minimize the amount of binding material required. If successive compression forces perpendicular to each other were applied to a charge of material, bindings would have to be subsequently applied along each axis of compression in order to maintain the compressed state of the charge. Further, especially with charges such as hay or straw where the fibers are oriented perpendicularly to the axis of the first compression, applying a subsequent compression force parallel to the axis of the fibers may require prohibitively large forces or may damage the fibers.

Several machines have been heretofore used for baling fibrous material, but each has significant drawbacks. Ast (U.S. Pat. Nos. 4,718,335 and 4,676,153) discloses a method and apparatus, respectively, for recompressing bales of fibrous material such as forage. Compression is performed with only one hydraulic cylinder which must be sufficiently large to apply the maximum force required to achieve the desired compaction, thereby necessitating a larger energy expenditure than a multistep compactor using progressively larger and more powerful cylinders of shorter stroke. Also, the Ast apparatus tightly binds fully compressed bales which, even though the bales are "decompressed" by a 30-second maintenance of maximal compression, subjects the binding twine to high recoil forces after the bale is released from the apparatus. Bales compressed more than obtainable with the Ast apparatus would experience an unacceptably high failure rate of bale bindings, despite "decompression," unless metal wire or strapping were used. Further, Ast has no means to ensure uniformity of mass among compressed bales.

Thomas and Logan (U.S. Pat. No. 3,266,096) disclose a multistep compression apparatus wherein the pressure applied in each step to a randomly oriented batch of material is successively increased and applied in a direction perpendicular to that of the previous step. As a result, the material is compressed in all three dimensions. Such an apparatus would not be appropriate for compressing field bales of hay or straw which effectively cannot be compressed to high density in a direction substantially parallel to the axis of the individual stalks.

Stangl (U.S. Pat. No. 3,089,410) discloses an apparatus for pressing light fibrous material, such as cotton or wood pulp, into bales, wherein a bale is built up from successive, volumetrically defined layers of randomly oriented fibers. The Stangl apparatus utilizes only one compression piston which must stroke many times before a full bale is formed. Such an apparatus is simply inappropriate for compressing existing bales of hay or straw to high density in an energy efficient and timely manner.

Several other compaction machines have been patented. However, each is unsuitable for compressing fibrous material along a single axis into high-density bales. For example, Tezuka (U.S. Pat. No. 3,451,190) discloses a device intended to squeeze liquid from trash and garbage, compact it into discrete blocks, and apply a tightly-adhering wrapper therearound. The Tezuka device utilizes four hydraulic cylinders for compaction alone, performed along two axes, as well as additional cylinders for actuation of gates and wrapping equipment. Hence, the Tezuka device would require much larger pumping capacity, and consume more energy and time per bale, than the present invention. More importantly, the Tezuka device applies perpendicular compression forces, which are unsuitable for fibrous material such as hay or straw. Further, the Tezuka device does not show the much simpler concept in the present invention of opposing cylinders that perform sequential compression strokes toward each other and against each other's compression platens. Finally, the Tezuka device is not designed to achieve the degree of compression attainable with the present invention.

Del Jiacco (U.S. Pat. No. 3,996,849) discloses an apparatus for compaction and baling of large, heavy materials such as scrap automobiles. Unlike the present invention, however, only one hydraulic cylinder actually performs the compression. The second cylinder merely elevates the finished bale out of the compression chamber. Hence, the Del Jiacco device is unsuitable for high-density compression of fibrous material for substantially the same reasons as the Ast device, discussed supra.

Fetters (U.S. Pat. No. 4,483,245) discloses a device for compressing and wrapping bundles of large articles, such as cut Christmas trees, in cylindrical "cartridges" for shipment. That device is totally unsuited for compressing charges of hay, straw, or other loose fibrous material into high density bales.

Hence, a primary object of the present invention is to provide a method and apparatus for compressing low-density charges of coarse fibrous material, such as, hay, straw, peat, or other herbaceous forage, into high-density bales having uniform size, shape, and weight for cost-effective shipping over long distances and for economical storage.

Another object of the present invention is to provide a method and apparatus that compresses low-density charges of such fibrous material in an energy-saving and time-efficient manner through a design that eliminates the need to move large, powerful pistons requiring large volumes of oil through long, relatively low-compression strokes and that makes multiple use of hydraulic oil whenever possible, thus saving both power and cycle time.

Another object of the present invention is to provide a method and apparatus that performs the compression from both directions along the longitudinal axis of the charge, allowing control of the dimensional profile of the bale transverse to the axis of compression, minimizing damage to the fibers, and requiring a minimal amount of binding material.

Another object of the present invention is to provide a method and apparatus wherein each charge is overcompressed, plastic strapping applied loosely thereto and the heat-sealed ends of the binding allowed to set, and the charge subsequently allowed to expand into the bindings, thereby alleviating high post-compression mechanical stress on bindings and obviating the need to use metal binding materials.

SUMMARY OF THE INVENTION

In accordance with the foregoing objects, the present invention comprises a method and apparatus for compressing longitudinally extended low-density mounds of coarse fibrous material, such as hay, straw, peat, or other herbaceous animal forage, into high-density bales of uniform size, shape, and weight. The compression is performed in two steps in a precompression/compression chamber along the longitudinal axis of the low-density mound. The low-density material may be weighed to ensure that only a preselected mass of material is subsequently compressed. The preselected mass, or "charge," is loaded into a precompression/compression chamber defined in part by side panels and first and second opposing movable end platens. A longitudinal precompression stroke is applied to the charge via the first end platen, pushed by a first hydraulic piston toward the second end platen. The first hydraulic piston is sized to provide sufficient force of relatively low magnitude to the charge over a long stroke. The long precompression stroke moves the charge from its initial loaded position through the non-compression portion of the stroke and into the compression chamber. The precompression stroke also partially compresses the charge, traversing in the shortest amount of time the low-compression portion of the compression resistance curve and using a minimum volume of hydraulic oil. The first end platen is then latched at its full-stroke position via a pair of hydraulically actuated dogs. Next, a compression stroke is applied to the charge in a direction opposite to the precompression stroke via the second end platen pushed toward the first end platen by a large-diameter, short-stroke second hydraulic piston. The second hydraulic piston is sized to provide a relatively high magnitude force to the charge over a short stroke to traverse in the shortest amount of time the high-compression portion of the compression resistance curve to full compression using a minimum volume of hydraulic oil. Afterward, the fully compressed charge is pushed out from between the opposing first and second end platens via an "eject" platen pushed by a third hydraulic piston mounted transverse to the compression chamber. Ejection pushes the compressed charge between two stationary platens that hold the charge in a longitudinally fully compressed state while binding material is loosely applied therearound. In the case of a plastic heat-fused binding, the elapsed period the charge is retained in the stationary platens allows the fused binding ends to cool and reach maximal strength. The resulting bale is released from between the two fixed platens by subsequently compressed charges pushing from behind, after which it longitudinally expands a limited amount into the bindings to the desired bale length. After ejection, as the large-diameter compression piston retracts, oil from the piston end of that cylinder is routed directly to the rod ends of the eject and precompression cylinders, thereby causing them also simultaneously to retract, reducing hydraulic pumping demand and lessening the cycle time. As a result, the present invention achieves higher bale compression using less hydraulic oil, less time, and less power than existing methods and apparatuses.

The foregoing and other objects, features, and advantages of the invention will become more apparent from the following detailed description of a preferred embodiment which proceeds with reference to the accompanying drawings.

DETAILED DESCRIPTION

Introduction

A fibrous material compressor and method in accord with the present invention can be used for creating dense bales of any fibrous material of organic or inorganic origin, including, but not limited to, agricultural products, textile and rope fibers, pulp, herbaceous forage for livestock, or fibrous refuse such as trimmings from carpet mills or shredded refuse-derived fuel. Although the following description is particularly relevant to a compressor intended for baling hay or other herbaceous forage for livestock, the device can be used for other materials with appropriate changes in magnitude of compressive forces, stroke lengths, and other parameters without departing substantially from the scope of the present invention.

Figure 1:
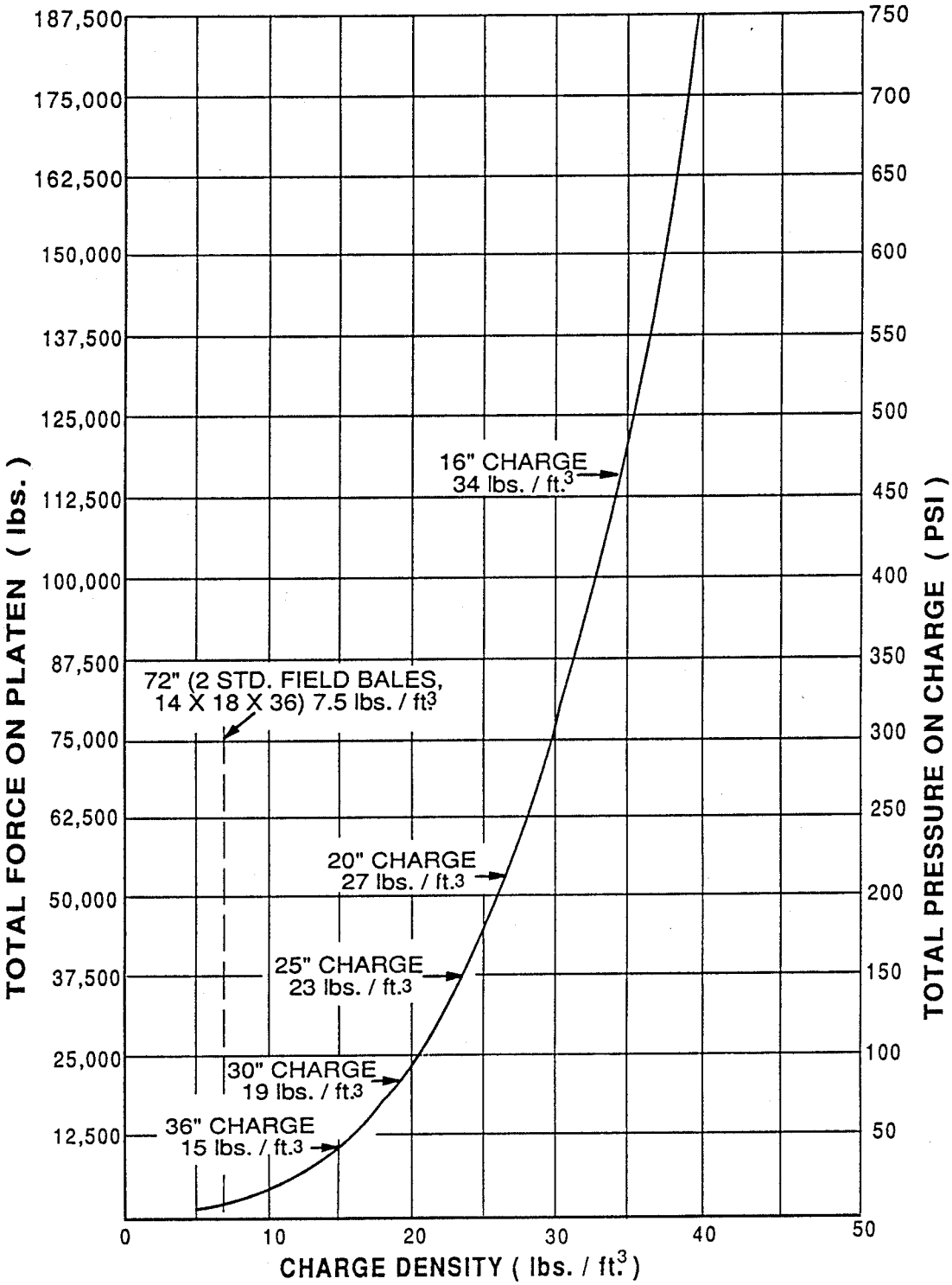
FIG. 1 is a plot of a typical compression curve for charges of hay, the plot showing the amount of compressive force required to achieve particular bale densities. Also shown are the densities of compressed bales that started with two 14×18×36 standard field bales compressed to various lengths.

Compression curves for charges of dried herbaceous forage for livestock, such as, hay, alfalfa, or straw, where the axes of individual plant stalks are oriented substantially perpendicular to the axis of compression, tend to be substantially exponential in shape. As shown in FIG. 1, the resistance exerted by the charge to a longitudinal compression force does not approach maximum values until nearly the end of the compressive stroke. The present invention performs such compression in a time- and energy-efficient manner by employing two compression means: a long-stroke, relatively low-magnitude first compression means to traverse the lower portion of the compression curve (FIG. 1), thereby achieving a "precompression," and a short-stroke, high-magnitude second compression means to complete the compression from the opposite direction.

Overall System

Figure 2A:
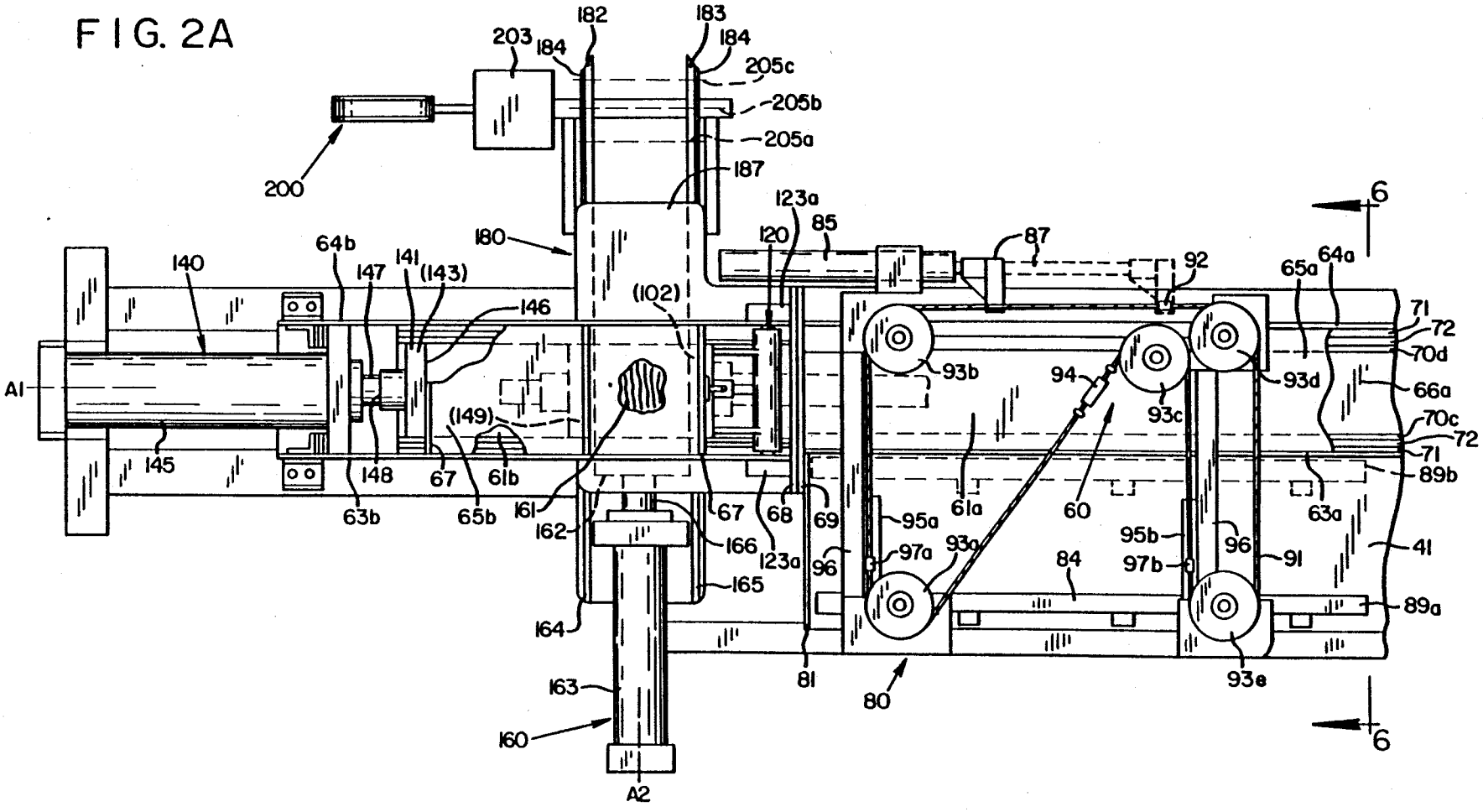
FIGS. 2A and 2B are a plan view of the preferred embodiment with certain parts broken away, showing the positions of certain elements at the completion of the precompression stroke of the precompression cylinder.
Figure 2B:
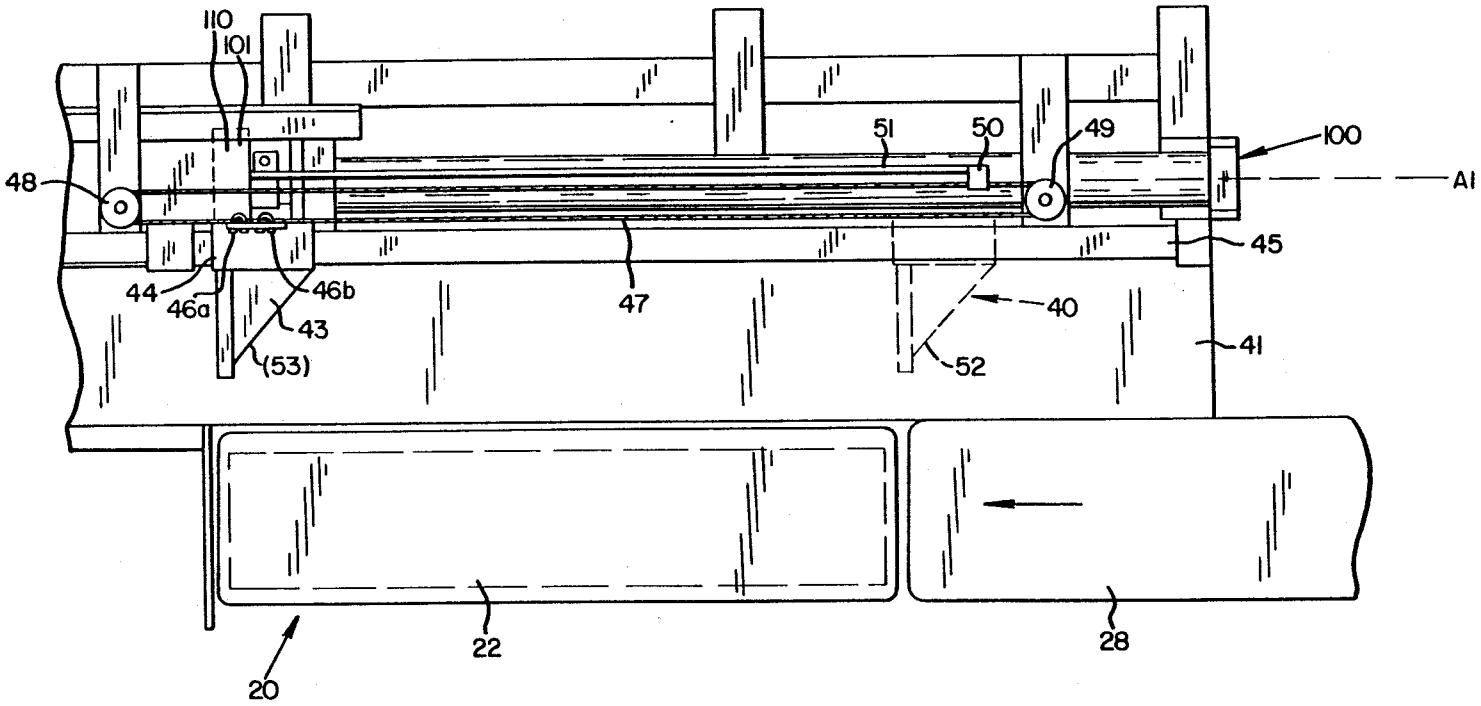
Figure 10:
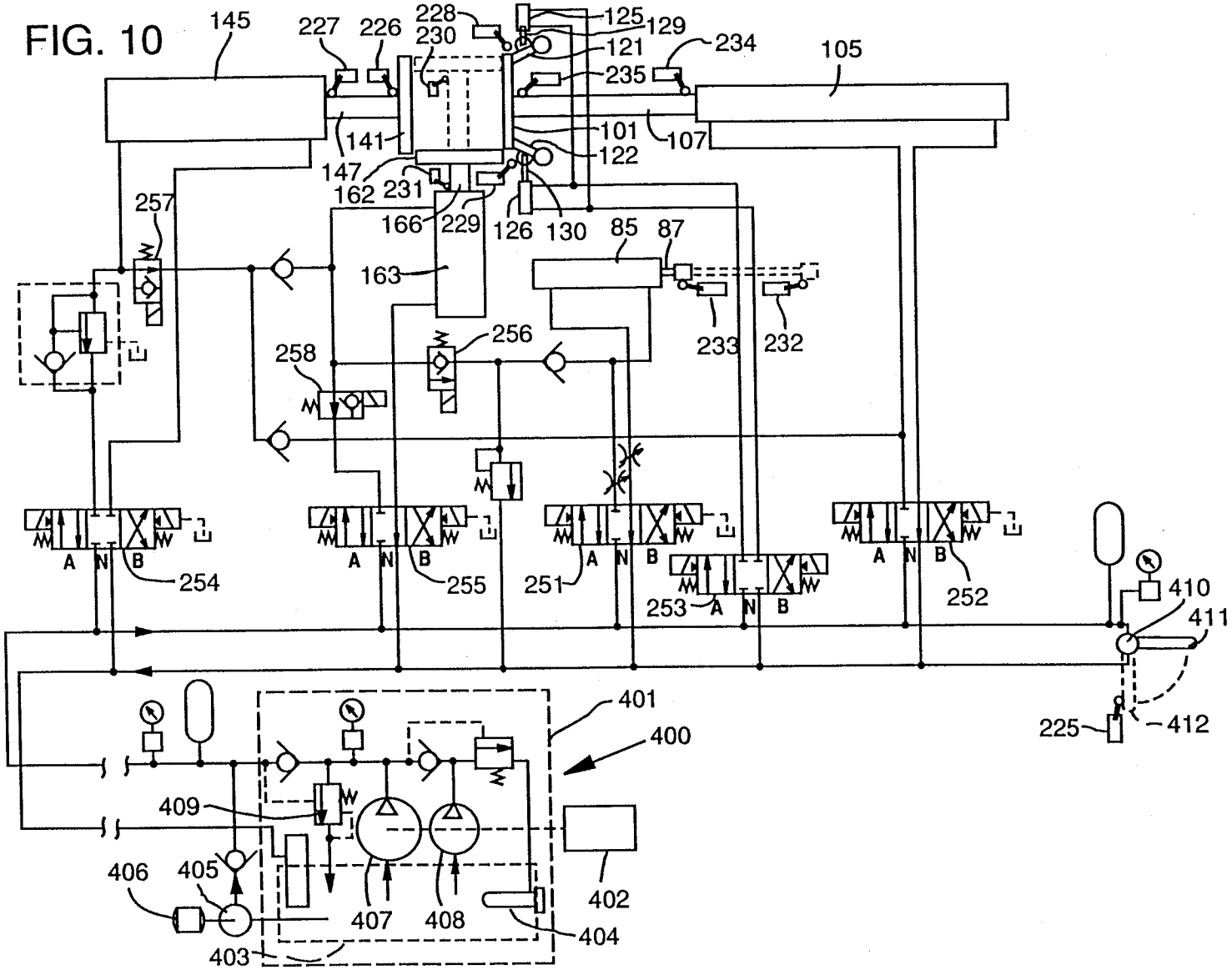
FIG. 10 is a schematic diagram of the hydraulic system according to the preferred embodiment.
Figure 11A:
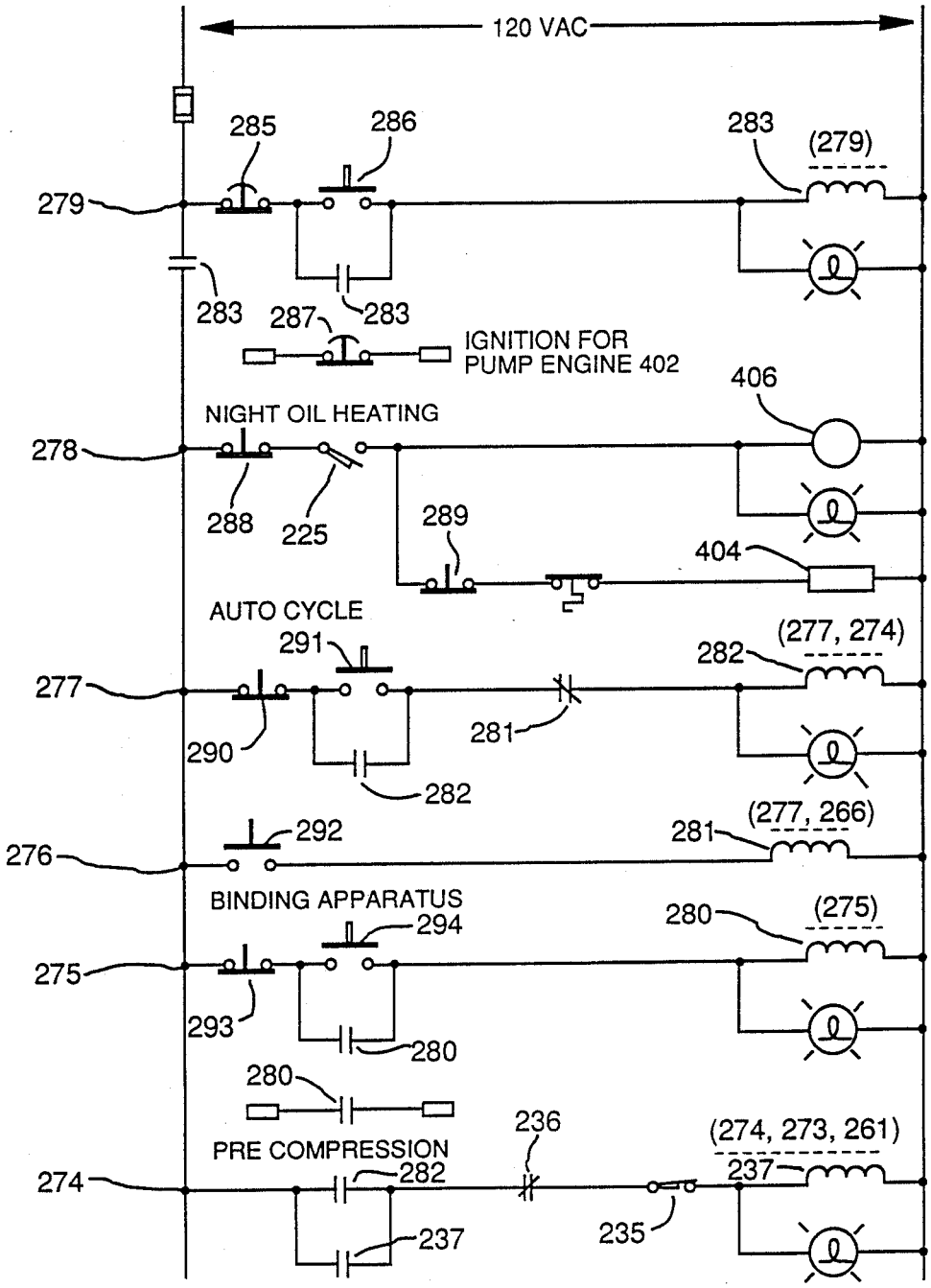
FIGS. 11A, 11B and 11C are schematic diagrams of the electrical control system according to the preferred embodiment.
Figure 11B:
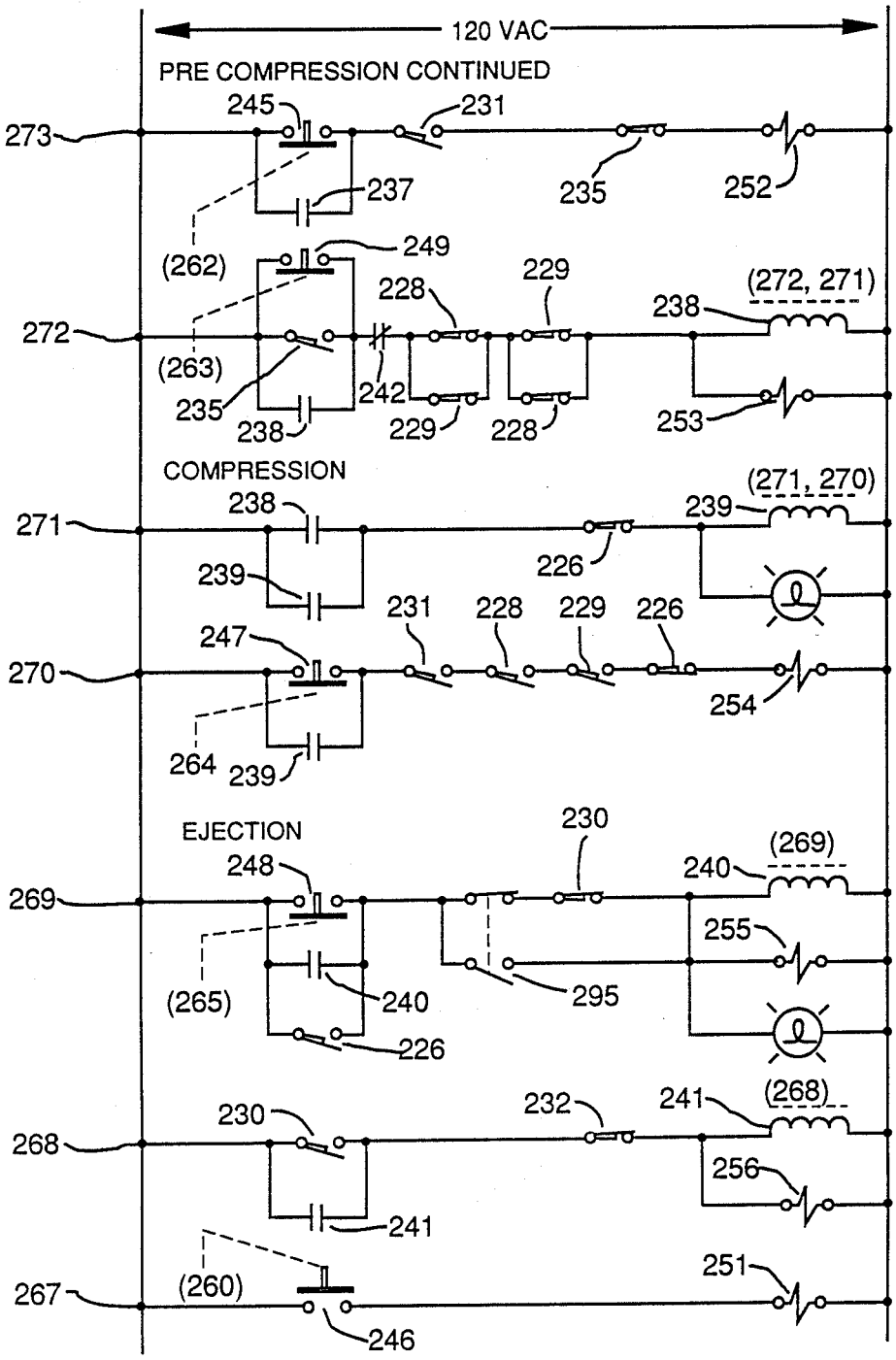
Figure 11C:
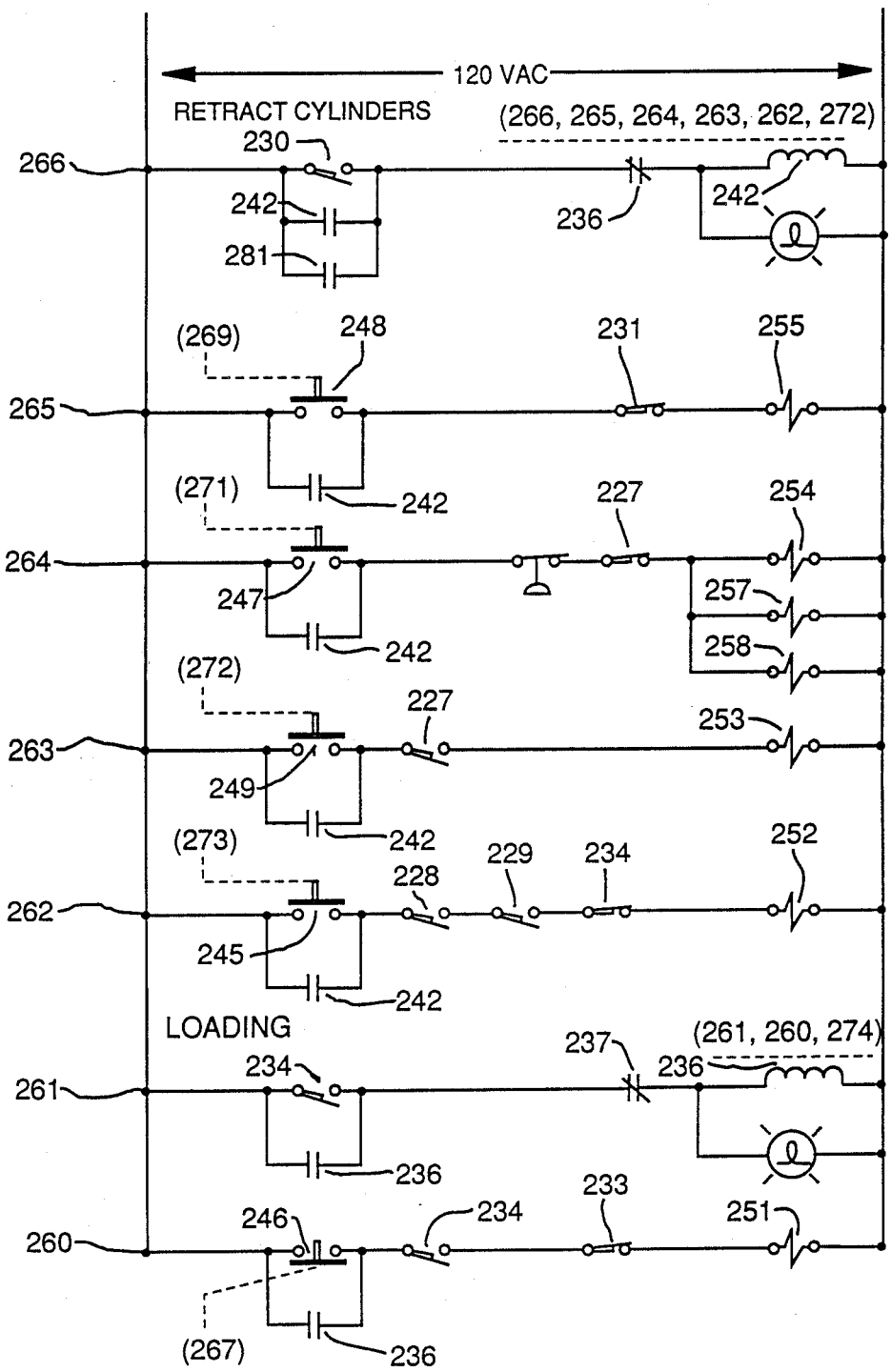

Referring particularly to FIGS. 2A and 2B, a preferred embodiment of a fibrous-material compressor 10 in accordance with the present invention includes a weighing means 20, a preload means 40, precompression and compression chambers 60, a loading means 80, a precompression means 100, a latching means 120, a compression means 140, an ejection means 160, a holding means 180, a binding means 200, a hydraulic pumping means 400 (FIG. 10) and a control means 220 (FIGS. 11A–11C).

The weighing means 20 measures the weight of the material destined to be compressed. The preload means 40 receives material from the weighing means 20 and moves it into position for loading. The loading means 80 transfers the material into a precompression chamber wherein the precompression means 100 performs a first longitudinal compression of the material to intermediate density while moving the material to the compression chamber. The latching means 120 then anchors the precompression means 100 at full stroke, after which the compression means 140 completes the longitudinal compression of the material to high density. The ejection means 160 moves the mass of fully compressed material laterally out of the compression chamber to a holding means 180 that maintains the material in a fully compressed state. The holding means 180 is surrounded by a binding means 200 which applies binding material around both the holding means 180 and the fully compressed material. The fully compressed and bound bale is subsequently released from the holding means 180, after which it longitudinally expands into the bindings a limited, predetermined amount.

Weighing Means

Figure 3A:
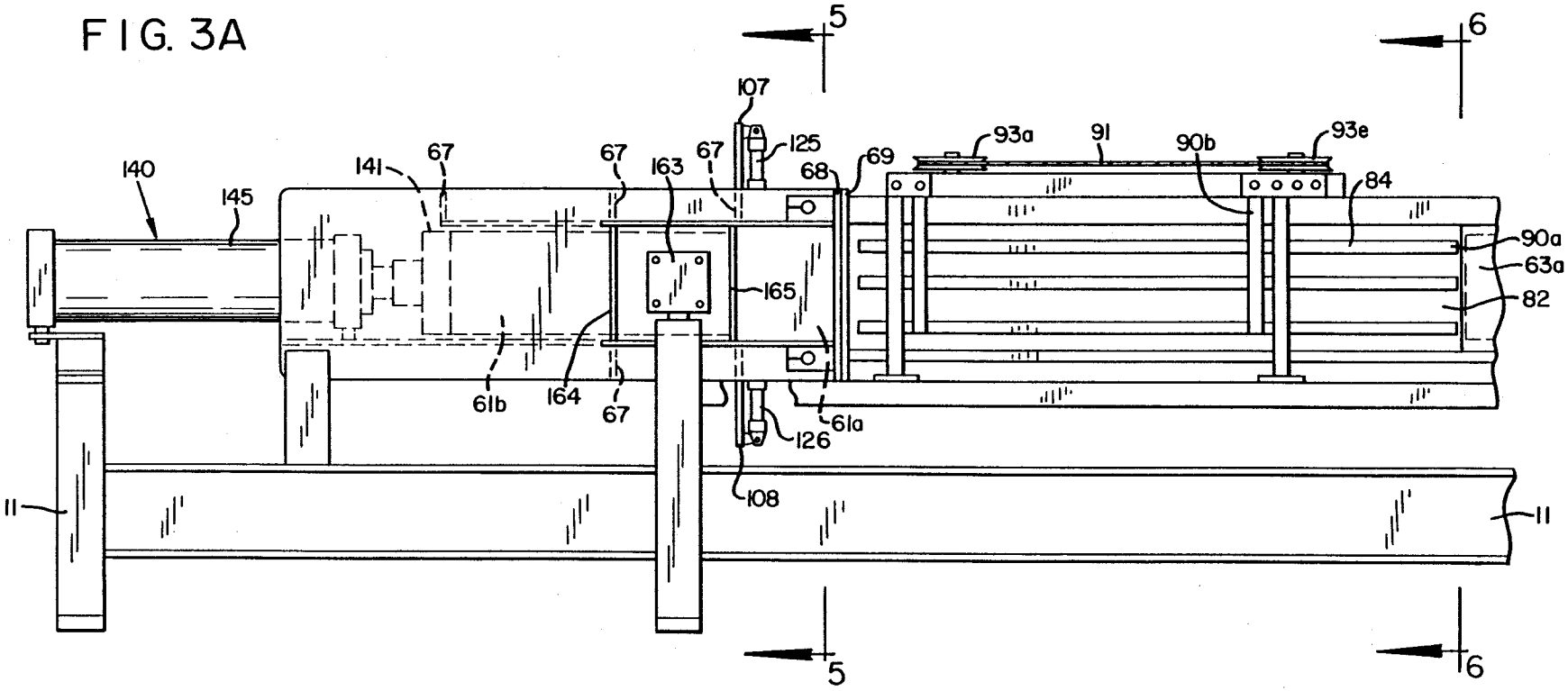
FIGS. 3A and 3B are a front elevational view of the preferred embodiment.
Figure 3B:
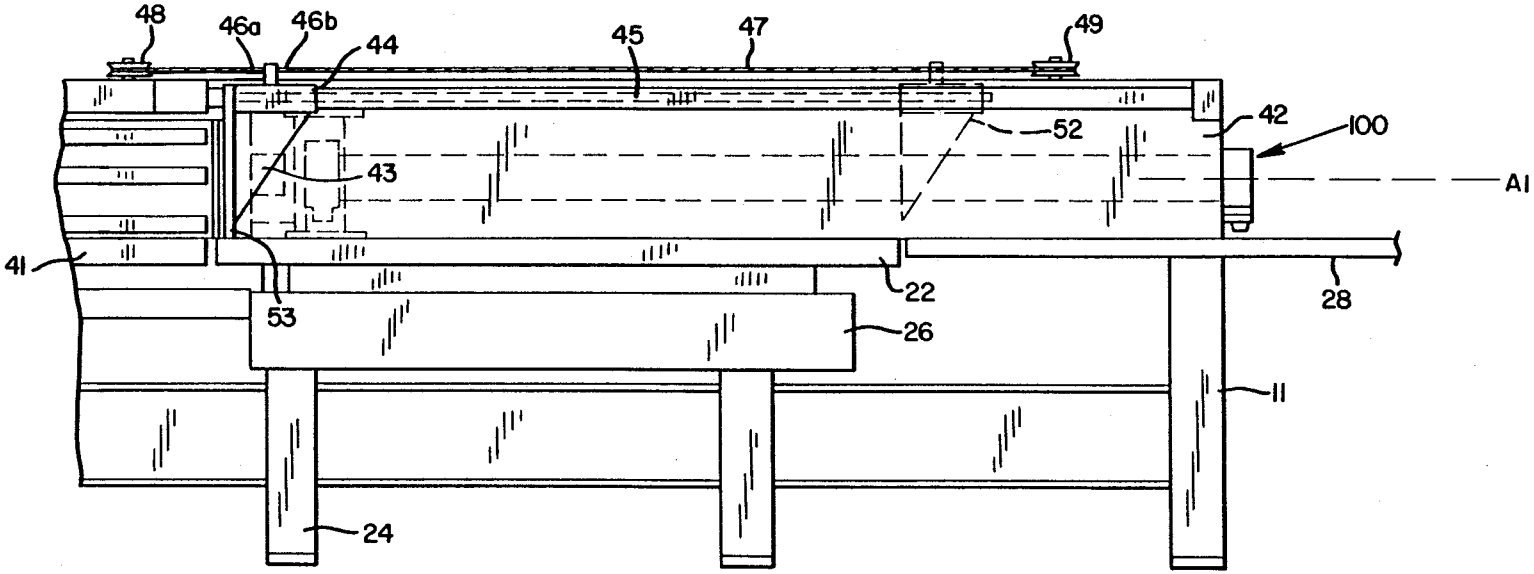

Referring further to FIGS. 2B and 3B, the weighing means 20 is comprised of a horizontal scale platform 22 supported by a frame 24. The scale platform can rest on or be suspended by any of several mechanical or electronic devices 26 currently available that measure the combined mass of the scale platform 22 and any material loaded thereon. The weighing means 20 preferably should display only the net weight of the material loaded on the scale platform 22. The height of the scale platform 22 should be such that material can be readily loaded thereon from an upstream source for weighing, and unloaded therefrom onto the preload platform 41 after weighing.

The weighing means 20 may be located at the terminus of a conveyer 28 which transports material from, for example, a drying apparatus or bulk storage location. Alternatively, the weighing means may be located, for example, where low-density bales from the field are unloaded. If a conveyer is used, the speed thereof should be adjustable so that the rate of material added to the conveyer is equal to the rate at which material is removed at the weighing means.

The present invention is designed to perform compression only along one axis. As a result, material loaded on the weighing means 20, whether obtained from field bales or from a supply of loose material, should already be arranged or stacked to have the desired cross-sectional dimensional profile of a fully compressed bale. Experience has shown that, with hay or straw, if the individual fibers or stalks are oriented substantially perpendicular to the axis of compression, full compression does not significantly change the cross-sectional dimensional profile of the charge. For example, if two standard field bales of hay (14"×18"×36" each) are compressed along their longitudinal axis via the present invention, a single, dense bale may be obtained having dimensions 14"×18"×20". Field bales typically already have properly oriented fibers. Loose material, such as hay from a drying apparatus, should be arranged before weighing into a longitudinally extended stream having properly oriented fibers and the requisite transverse dimensional profile.

The weighing means 20 can either be manually or automatically loaded, depending upon the existing form of the material to be compressed and the requirements of the particular facility where the present invention is being used. Automatic loading may be preferable if a continuous stream of material is being conveyed to the weighing means. If the weighing means 20 is automatically loaded, a separating device (not shown) should be employed to interrupt the flow of material onto the scale platform 22 whenever the desired mass of material thereon has been attained.

Manual loading and unloading of the weighing means 20 may be preferable if the material to be compressed is in the form of discrete low-density bales such as field bales or if the present invention will be used to compress only a relatively small batch of material. If the material has been previously baled, the bindings should be removed before weighing. Previously baled material can also be automatically loaded on and unloaded from the weighing means 20. In such case, a separating device (not shown) should be capable of partitioning a low-density bale of the material, if necessary, to ensure that only the desired mass of material is loaded onto the scale platform 22.

Transferring weighed material from the weighing means 20 to the preload means 40 can be performed either automatically or manually. Various mechanical devices are currently available for such tasks.

Preload Means

Referring further to FIGS. 2B and 3B, the preload means 40 is comprised in part of horizontal preload platform 41, vertical plate 42 and reciprocally movable vertical preload platen 43. The preload platen 43 can be actuated by any of several means, including a hydraulic cylinder or via a mechanical linkage to the precompression means. In a preferred embodiment as shown in FIGS. 2B and 3B, the preload platen 43 slidably moves on bearing 44 along a horizontal rod 45. Both ends 46A and 46B of a metal wire cable 47 are attached to the upper portion of bearing 44. The cable 47 is routed tautly around sheaves 48 and 49, forming a complete circuit. The cable 47 is also attached near midlength 50 to the end of a horizontal rod 51 extending toward the cable 47 from a precompression platen 101. Whenever the precompression platen 101 moves to the left toward a compression platen 141 (discussed infra), rod 51 pulls cable end **46*a*, moving the preload platen 43 in the opposite direction toward its fully retracted position 52. Whenever the precompression platen 101 retracts away from the compression platen 141, rod 51 pulls cable end 46*b*, moving the preload platen 43 in the opposite direction toward fully extended position 53. Hence, the precompression platen 101 and preload platen 43 move in a cooperative manner: when the precompression platen 101 is applying force to a loaded charge of material, the preload platen 43 is moving toward the retracted position 52 in preparation for receiving a fresh charge from the weighing means 20; when the precompression platen 101 is retracting after compression of a charge is complete, the preload platen 43 extends toward position 53**, thereby moving a fresh charge into position for subsequent loading.

Precompression and Compression Chambers

Figure 2C:
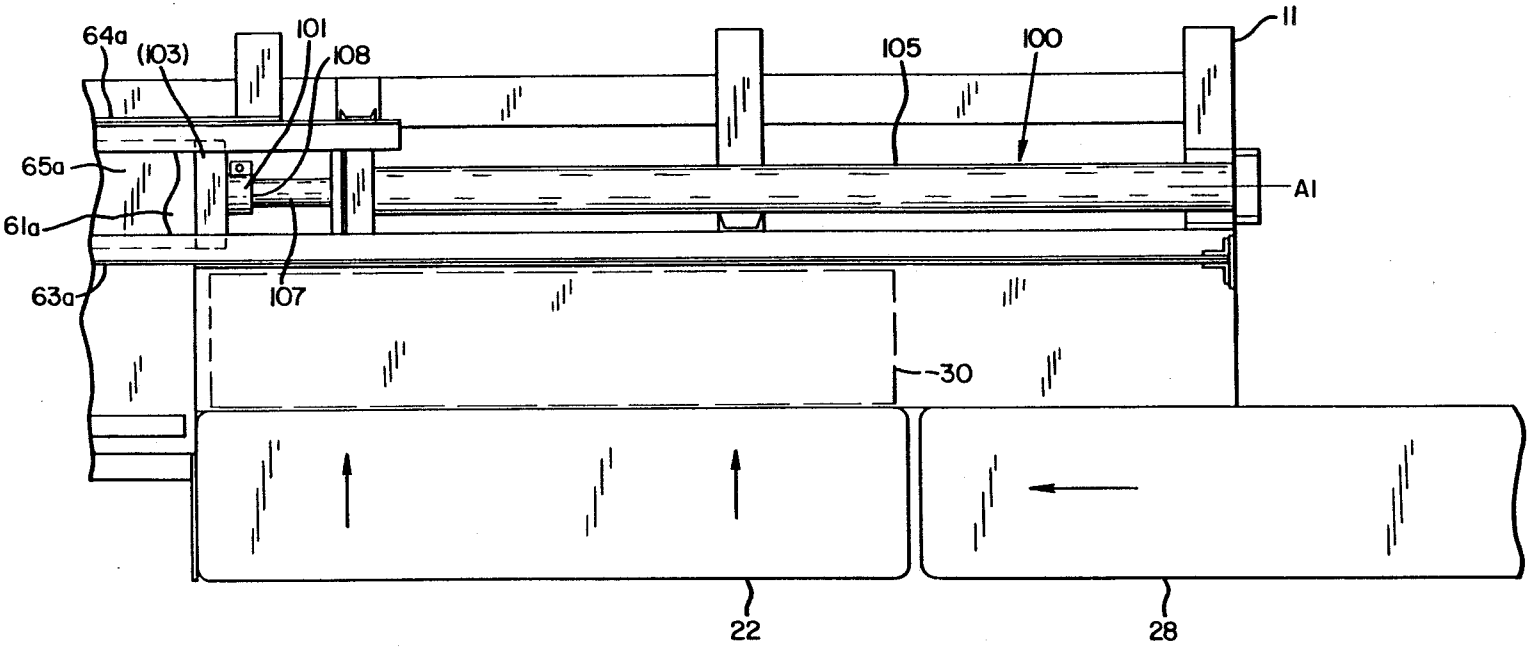
FIG. 2C is a plan sectional view of the apparatus shown in FIG. 2B with the preloading means removed.

Referring now to FIGS. 2A and 3A, a precompression chamber **61*a* and a compression chamber 61*b* are contiguous spaces, together comprising a longitudinally extended space having a horizontal axis Al and defined by coplanar side plates 63*a* and 63*b* along one side thereof, coplanar side plates 64*a* and 64*b* along the opposing side thereof, coplanar top plates 65*a* and 65*b*, coplanar bottom plates 66*a* and 66*b*, a movable first end or "precompression" platen 101, and a movable second end or "compression" platen 141. The precompression chamber 61*a* is positioned adjacent to preload platform 41 and is adapted to receive a charge of material from the platform through an opening 82 in the side plate 63*a*, as discussed subsequently. The precompression chamber 61*a* extends between the full stroke position 102 (FIG. 2A) and fully retracted position 103 (FIG. 2C) of the precompression platen 101. The compression chamber 61*b* extends between the full stroke position 102 of the precompression platen 101 and the fully retracted position 143 of the compression platen 141** (see FIG. 2A).

Figure 5:
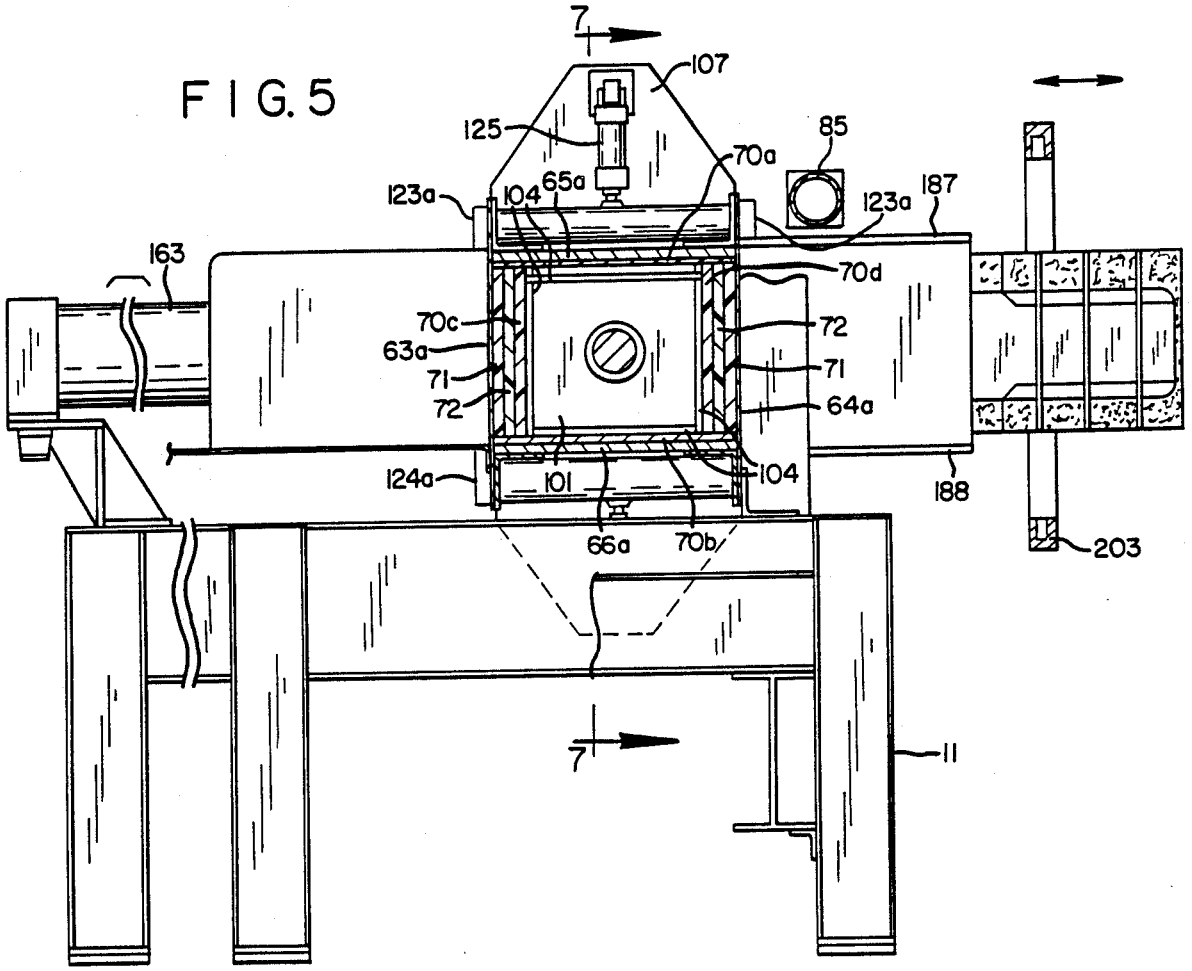
FIG. 5 is an enlarged transverse sectional view through the precompression chamber taken along line 5—5 of FIG. 3A.

As shown in FIG. 5, the transverse profile of the precompression and compression chambers is rectangular with dimensions substantially equal to the desired transverse dimensional profile of a fully compressed bale produced therein. The first side plates **63*a* and 63*b*, second side plates 64*a* and 64*b*, top plates 65*a* and 65*b*, and bottom plates 66*a* and 66*b* are typically fabricated from flat metal stock such as mild steel, having a thickness appropriate to contain the radial forces generated by a charge of fibrous material being axially compressed in the precompression and compression chambers. The plates may be welded or bolted together using appropriate connecting members. External ribs 67** to increase the strength of the chamber may be provided as required.

Figure 7:
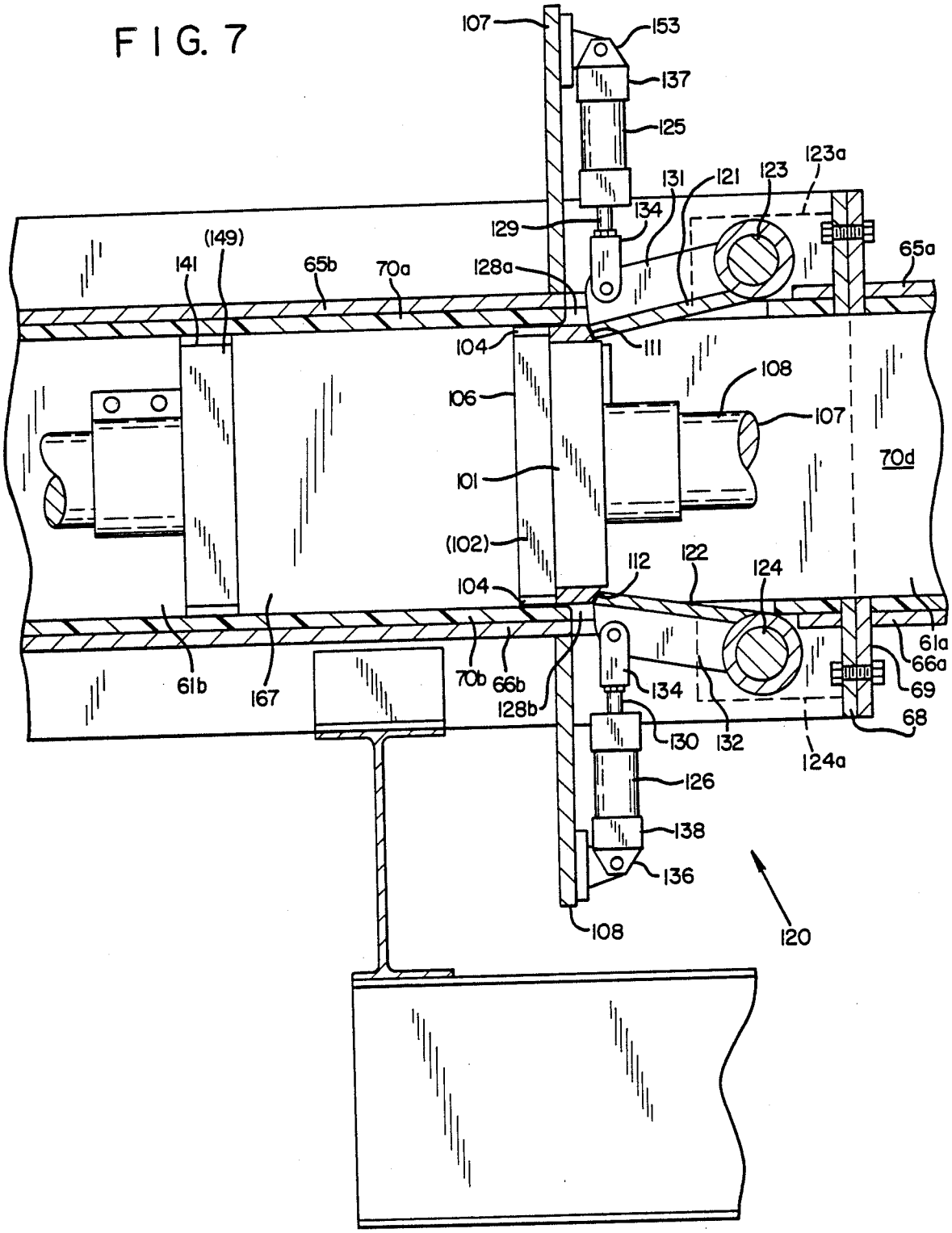
FIG. 7 is an enlarged vertical sectional view taken along line 7—7 of FIG. 5 showing details of the latching means for the precompression platen.

As shown in FIGS. 2A, 3A and 7, the units making up the precompression chamber **61*a* and compression chamber 61*b* can be made separable from each other via mating flanges 68 and 69 coaxially bolted together. The union of flanges 68 and 69 must be located such that it does not obstruct the loading opening 82 in side plate 63*a***, discussed infra.

As shown in FIG. 5, the interior surfaces of the side, top, and bottom plates defining both the precompression chamber **61*a* and compression chamber 61*b* preferably are lined with sheets of plastic 70*a*, 70*b*, 70*c* and 70*d*. The plastic liners, fabricated from, for example, UHMW polyethylene, have a lower coefficient of friction than steel and serve as a bearing surface for the precompression and compression platens in slidable contact therewith. Additional plastic or metal shims 71 and 72 of selected thicknesses can also be affixed to the interior surfaces of side plates 63*a*, 63*b*, 64*a* and 64*b* beneath the UHMW polyethylene liners to reduce the transverse dimensional profile of the precompression and compression chambers. Hence, a single compressor according to the present invention can be custom-sized over a limited range to produce bales having one of several transverse dimensional profiles. For example, a chamber having a horizontal transverse dimension of 18 inches can be narrowed to 14 inches by adding two 1-inch thick shims 71 and 72 to inside surfaces of opposing side plates 63*a*, 63*b*, 64*a* and 64*b* and by using 14-inch wide precompression and compression platens 101 and 141**, respectively. Generally, liners and shims are bolted into place but other means of affixing them are also possible.

The edges of the precompression platen 101 and compression platen 141 in slidable contact with the plastic liners on the inside surfaces of the precompression and compression chambers preferably are also lined with thin sheets of plastic 104 and 144, respectively, such as UHMW polyethylene to minimize friction.

Loading Means

Figure 6:
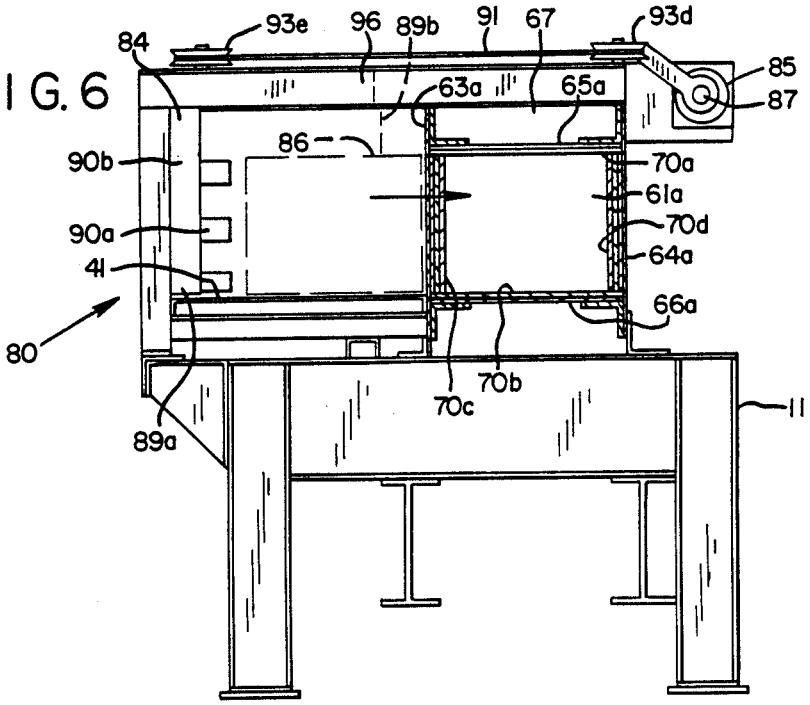
FIG. 6 is a transverse sectional view of the loading means and precompression chamber taken along line 6—6 of FIG. 3A.

Referring further to FIGS. 2A, 3A and 6, a loading means 80 is provided for pushing a weighed low-density charge 86 of fibrous material, after being moved to a position 83 in lateral relation to the precompression chamber **61*a* and parallel to axis A1 via the preload platen 43, into the precompression chamber 61*a* through the loading opening 82 in side plate 63*a*. The loading means 80 is comprised basically of a loading fence 84 and a load cylinder 85**.

The loading opening 82 has vertical height substantially equal to the height dimension of a longitudinally extended charge of material to be compressed, i.e., the height of the precompression chamber **61*a*. The horizontal length of the opening is equal to that of a charge of material 86 ready to be urged into the precompression chamber 61*a***.

The loading fence 84 pushes the weighed, low-density charge 86 from the preload platform 41 through loading opening 82 into precompression chamber **61*a*. The loading fence 84 is actuated by the load hydraulic cylinder 85 which, via any of several possible mechanical linkages thereto, moves the fence in a horizontal direction perpendicular to axis Al, the distance being at least equal to the horizontal transverse dimension of a low-density charge 86. For loading low-density charges of hay or straw, the load cylinder 85 may have a 4-inch diameter piston, a 1.38-inch diameter rod, and a 28-inch stroke. A load cylinder 85** having different specifications may be more appropriate for loading other types of materials or low-density charges having substantially different dimensions.

The loading fence 84 is comprised of horizontal members 90*a* and vertical members 90*b*. The horizontal members 90*a* actually contact a charge of material 86 when pushing the charge into the precompression chamber 61*a*. Horizontal members 90*a* also form an obstruction-free surface covering loading opening 82 during the subsequent precompression of the loaded charge.

In the preferred embodiment, as shown in FIGS. 2A, 3A and 6, the loading fence 84 is attached to a cable and pulley mechanism that keeps the loading fence 84 oriented parallel to axis A1. The load cylinder 85 is oriented parallel to axis Al, and piston rod 87 is attached to a cable 91 at location 92. Cable 91 is wrapped around sheaves 93*a*, 93*b*, 93*c*, 93*d*, and 93*e* and connected end-to-end via turnbuckle 94. The loading fence 84 is connected to the cable 91 via a pair of transverse extensions 95*a* and 95*b* which are affixed at 97*a* and 97*b*, respectively, to the cable. The extensions 95*a*, 95*b* are slidably mounted on bearing tracks 96 extending in a direction transverse to axis Al. When the piston rod 87 extends from the position shown in FIG. 2A, it pulls cable 91 in a direction parallel to axis A1, which causes cable locations 97*a* and 97*b* to move in a horizontally transverse direction toward the precompression chamber 61*a*, causing the loading fence 84 to move toward the precompression chamber 61*a*to the position 89*b* shown via dashed lines in FIG. 2A. Conversely, retracting the piston rod 87 causes the loading fence 84 to move from position 89*b* to position 89*a*. Sheaves 93*a* and 93*c* must be spaced apart from one another sufficiently to ensure that turnbuckle 94 never rides over a sheave during full extension or retraction of piston rod 87.

Referring to FIG. 6, to load a fresh low-density charge 86 into precompression chamber 61*a*, the load cylinder 85 is operated to move loading fence 84 to the position 89*a*. After the fresh charge 86 has been moved into position adjacent to the loading opening 82, the load cylinder 85 extends piston rod 87, thereby pulling loading fence 84 transversely toward axis A1 to the second position 89*b*, so as to push the charge 86 transversely into the precompression chamber 61*a*. The loading fence 84 then remains in the second position 89*b*, serving as a continuation of side plate 63*a* and covering loading opening 82 during subsequent activation of the precompression cylinder 65.

Precompression and Compression Means

A precompression means 100 and a compression means 140 are provided for applying axial compressive forces to the ends of the low-density charge loaded into the precompression chamber 61*a*. Referring further to FIGS. 2B, 2C and 3B, the precompression means 100 is comprised basically of the precompression platen 101 and a precompression hydraulic cylinder 105. Referring to FIGS. lA and 3A, the compression means 140 is comprised basically of the compression platen 141 and a compression hydraulic cylinder 145.

The precompression platen 101 and the compression platen 141 have planar surfaces 106 and 146, respectively, in opposing relationship and parallel to each other, which press between them a charge of fibrous material during precompression and compression. Both platens are fabricated from strong rigid material such as mild steel to withstand the high-magnitude forces to which they are subjected during use.

The precompression platen 101 is axially mounted on the terminus 108 of the piston rod 107 of the precompression hydraulic cylinder 105, the cylinder being rigidly mounted to the ends of the top plate 65*a*, the bottom plate 66*a* , and the first and second side plates 63*a* and 64*a*, respectively. For compressing hay or straw, the precompression cylinder 105 may have a 5-inch diameter piston, a 3.5-inch diameter rod, and a 92-inch stroke, capable of applying 49,000 pounds of axial force to the precompression platen 101 at 2,500 psig hydraulic pressure during the precompression stroke. A precompression cylinder having different specifications may be more appropriate for precompressing other materials.

The compression platen 141 is axially mounted on the terminus 148 of piston rod 147 of the compression hydraulic cylinder 145, the cylinder being rigidly mounted to the ends of top plate 65*b*, the bottom plate 66*b*, and the first and second side plates 63*b* and 64*b*, respectively. For compressing hay or straw, compression cylinder 145 may have a 10-inch diameter piston, a 5-inch diameter rod, and a 16-inch stroke, capable of applying 196,000 pounds of force to the compression platen 141 at 2,500 psig hydraulic pressure during the compression stroke. A compression cylinder having different specifications may be more appropriate for compressing other materials.

When both the precompression platen 101 and compression platen 141 are at their full stroke positions 102 and 149, respectively (FIG. 2A), their opposing surfaces 106 and 146, respectively, are a predetermined minimal axial distance apart, the distance being substantially equal to the desired axial length of a fully compressed charge. (For compressing hay, the preferred axial distance is 14 inches. A greater or lesser axial distance may be more appropriate for compressing other materials.) Adjacent to the precompression platen 101 and compression platen 141 when at their full stroke positions 102 and 149, respectively, are openings 73 and 74 defined by first side plate 63*b* and second side plate 74*b*, respectively. The horizontal width of openings 73 and 74 is substantially equal to the minimal axial distance between the precompression platen 101 and compression platen 141 when at their full-stroke positions. The vertical height of openings 73 and 74 is substantially equal to the desired corresponding height of a fully compressed charge. Openings 73 and 74 are coaxial with horizontal axis A2.

Latching Means

A latching means 120 is provided for preventing the precompression platen 101, when it is in the full-stroke position 102, from backing toward its retracted position 110 whenever the compression cylinder 145 is compressing a charge between the precompression platen 101 and compression platen 141. Such latching is required because the force applied by the compression cylinder 145 is sufficiently great to overcome the opposing force applied by the precompression cylinder 105.

Referring to FIGS. 5 and 7, the latching means 120 is comprised basically of two hydraulically actuated dogs 121 and 122 that engage the trailing edges 111 and 112, respectively, of the precompression platen 101 after it reaches the full-stroke position 102. The dogs 121 and 122 are pivotally mounted in opposing relationship on axles 123 and 124, respectively, mounted on suitable brackets (e.g., brackets 123*a* and 124*a*) equidistantly above and below axis A1, each axle oriented perpendicularly to axis A1. Each dog 121 and 122 is actuated by a short-stroke hydraulic cylinder 125 and 126, respectively, mounted on vertical plates 107 and 108, respectively. Hence, the dogs 121 and 122 pivot in a vertical arc. During retraction, the dogs 121 and 122 are simultaneously pulled away from axis A1 via dog cylinders 125 and 126, respectively, sufficiently to allow the precompression platen 101 to pass between them during a precompression stroke. As soon as the precompression platen 101 reaches the full stroke position 102, both dogs 121 and 122 are simultaneously pushed by their respective dog cylinders 125 and 126 through openings **128*a* and 128*b* in the plates 65*a* and 66*a*, respectively, thereby pivoting toward axis A1 sufficiently to engage the trailing edges 111 and 112, respectively, of the precompression platen 101**.

For hay baling purposes, each dog cylinder 125 and 126 may have a 1.5-inch diameter piston, 1-inch diameter rod, and 0.75-inch stroke. Dog cylinders having different specifications may be more appropriate in devices according to the present invention that are intended to compress other materials. Each dog cylinder 125 and 126 is pivotally mounted on both ends to prevent binding. Each piston rod 129 and 130 is mounted to a midline rib 131 and 132, respectively, on the surface of the corresponding dog facing away from axis A1 via a yoke 134 and 135, respectively. Each cylinder end 137 and 138 is mounted to the corresponding plate 126 or 127, respectively, via a yoke 135 and 136, respectively.

Ejection Means

An ejection means 160 is provided for pushing a fully compressed charge 161 transversely out of the "full compression" space 167 (that portion of compression chamber **61*b* between the precompression and compression platens 101 and 141, respectively, when at their full-stroke positions). The ejection means 160 is comprised basically of an eject platen 162, an ejection hydraulic cylinder 163, and opposing ejection side plates 164 and 165**.

Figure 8:
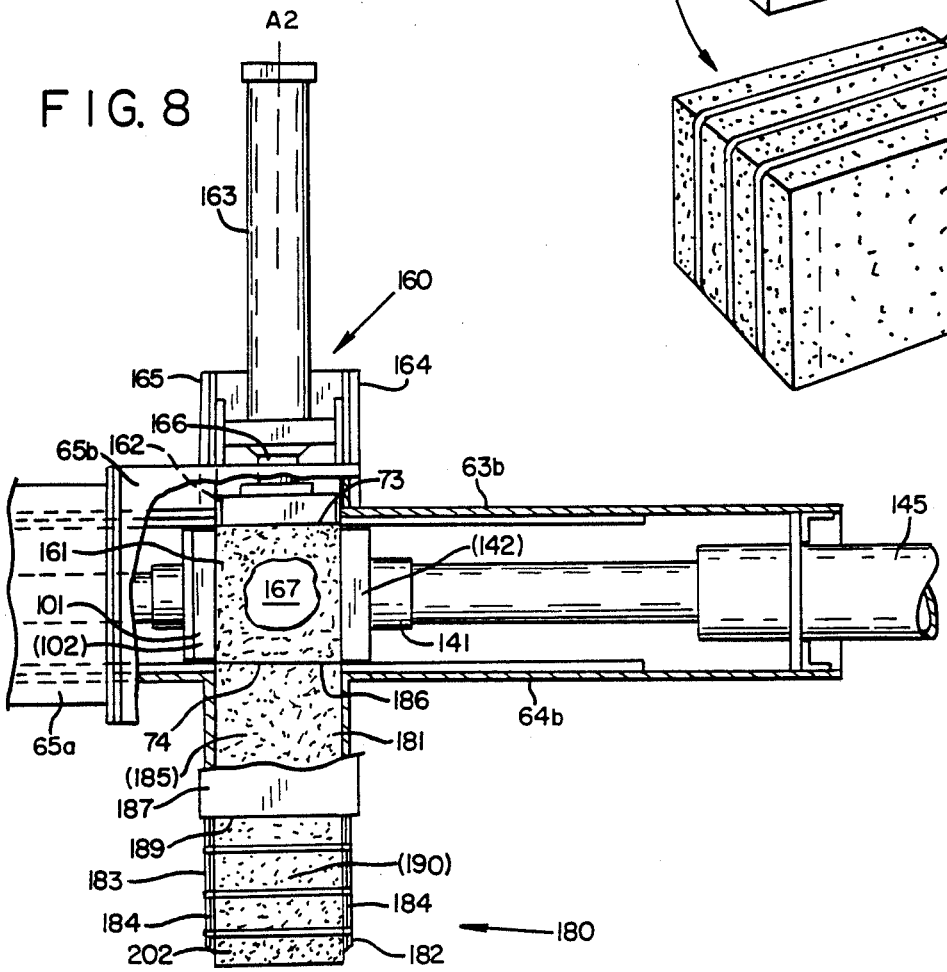
FIG. 8 is a plan view of the portion of the apparatus for ejecting and holding the compressed charges of fibrous material, portions of the apparatus being broken away to show details thereof.

Referring to FIGS. 2A, 3A and 8, the ejection side plates 164 and 165 are mounted upon the side plate **63*b* on the opposite sides of the opening 73, the plates 164, 165 being perpendicular to both axis A1 and parallel to an axis A2 passing midway therebetween. The ejection hydraulic cylinder 163 is rigidly mounted to the ejection side plates 164 and 165, coaxially with axis A2. An ejection platen 162 is axially mounted on a piston rod 166 of the ejection hydraulic cylinder 163, the face of the platen being parallel to the side plate 63*b*. In its fully retracted position, the ejection platen 162, together with the precompression platen 101 and the compression platen 141 in their full-stroke positions 102 and 142, respectively, form three right-angled vertical surfaces that partially define full compression space 167**.

For ejecting a fully compressed charge 161 of hay or straw, the ejection cylinder 163 may have a 7-inch diameter piston, a 5-inch diameter rod, and an 18-inch stroke, capable of applying 96,000 pounds of force to ejection platen at 2,500 psi hydraulic pressure during an ejection stroke. An ejection cylinder having different specifications may be more appropriate for ejecting fully compacted charges of other materials.

Holding Means

A holding means 180 is provided for maintaining an ejected charge 181 in a fully compressed state until binding material can be applied around the charge. Referring to FIGS. 2A and 8, the holding means 180 is comprised basically of horizontally extending side platens 182 and 183 mounted to the side plate **65*b* along the opposite edges of the opening 74, the platens 182 and 183 being perpendicular to axis A1 and parallel to axis A2 passing midway therebetween. Side platens 182 and 183 are preferably fabricated from thick (e.g., 1.5 inches), rigid mild steel flat stock provided with chamfers 184 on their outwardly facing longitudinal edges. The side platens 182 and 183 are at least as long as the horizontal transverse width of two fully compacted charges 181 placed side-by-side. For example, if the horizontal transverse width of a fully compacted charge 181 is 18 inches, then the side platens 182 and 183 should be at least 36 inches long. The width of the side platens 182 and 183 should be equal to or, preferably, less than the height of a fully compressed charge. The side platens 182 and 183 must be sufficiently rigid so that they will not significantly flex when a fully compressed charge 181** is pushed therebetween during ejection.

During an ejection stroke, the newly ejected charge 181 is pushed out of the full compression space 167 to a first position 185 within a chute 189. In this position, the surface 186 of the charge contacted by the eject platen 162 is substantially aligned with the inside surface of the side plate **64*b*. Hence, the next fully compressed charge 161 formed during the subsequent compression cycle is contained within the full compression space 167 defined by four vertical surfaces, namely, the precompression platen 101, the compression platen 141, the ejection platen 162, and the surface 186 of the previously ejected charge 181, and two horizontal surfaces, namely, the top plate 65*b* and the bottom plate 66*b*. The chute 189 is formed by a top plate 187 and a bottom plate 188, extending horizontally from the top plate 65*b* and bottom plate 66*b*, respectively, and by the side platens 182, 183. The plates 187, 188 have a length substantially equal to the horizontal width of a fully compacted charge. The chute 189 is occupied by an ejected charge 181 from the time the charge was ejected from space 167 until the charge is pushed further along between side platens 182 and 183 to a second position 190 by a subsequently ejected charge 161, as will be more fully explained. The surfaces of the plates 187 and 188, and of the platens 182 and 183**, are preferably lined with a low friction material (not shown).

Binding Means

A binding means 200 is provided for applying wire, cord, or strapping material 201 around an ejected, fully compacted charge 202 held in the holding means in the second position 190. (For binding hay or straw, it is preferable not to use metal binding materials because they can cause serious injury or death to animals if ingested.)

The binding means 200 may be any currently available and compatible binding apparatus positioned vertically in surrounding relationship to side platens 182 and 183 and coaxial with axis A2. An example is the Model APM-2F strapping machine manufactured by Cyklop Strapping Corporation, Downington, Penna.

Figure 9:
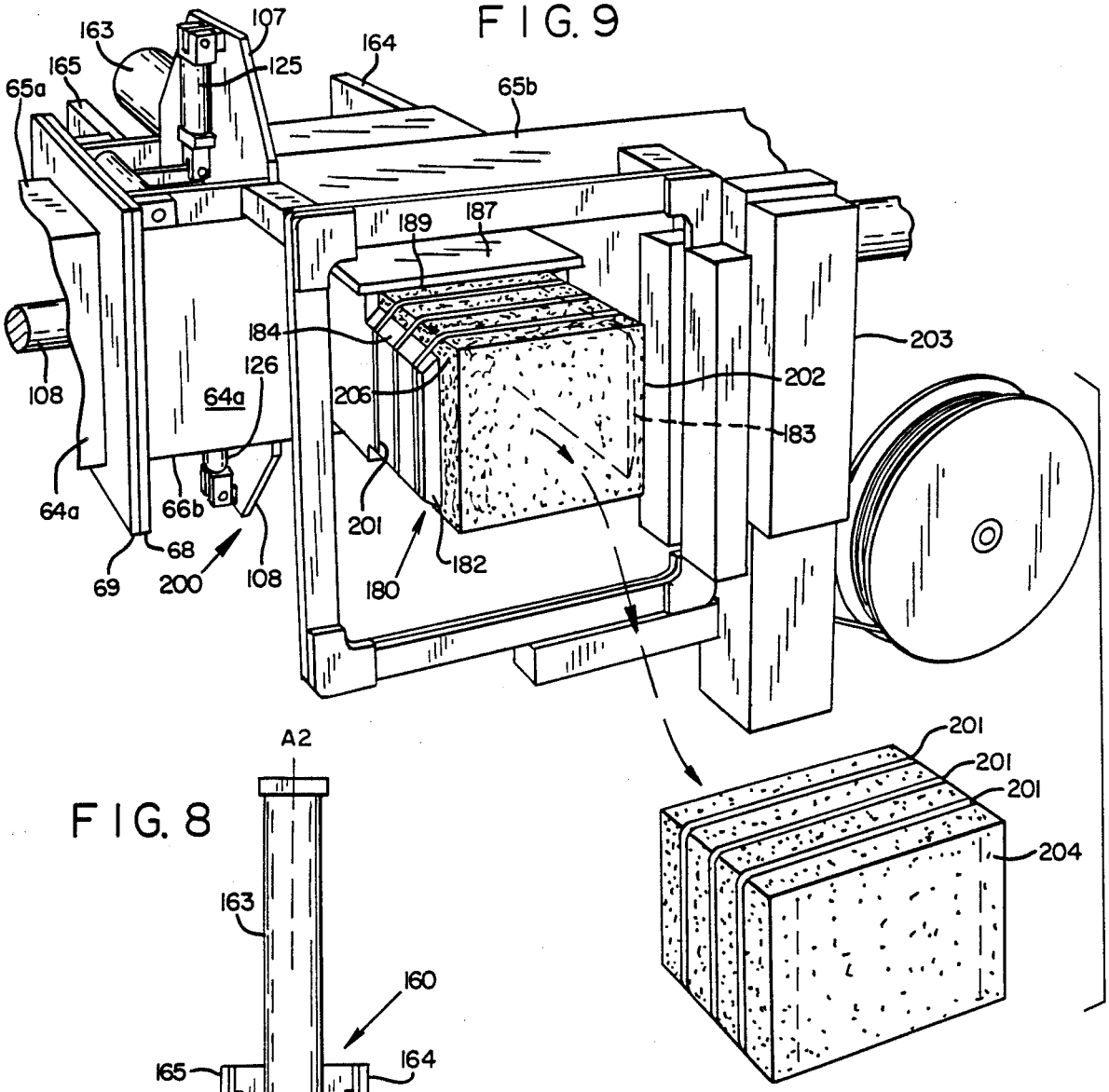
FIG. 9 is a schematic perspective view of the holding and binding means.

Referring to FIG. 8, the binding apparatus 203 surrounds the second compressed charge position 190 so that binding material 201 can be applied to a fully compressed charge 202. Referring now to FIG. 9, the binding apparatus 203 applies binding material 201 around both the fully compressed charge 202 and the side platens 182 and 183 at a preselected tension that will allow the charge 202 to be further pushed distally out from between the side platens 182 and 183. Typically, the binding apparatus applies binding material 201 in three locations 205*a*, 205*b* and 205*c* (see FIG. 2A) along the compressed charge 202, the bindings having a length greater than the perimeter of the compressed charge by a span indicated at 206 in FIG. 9.

Referring further to FIG. 9, after the charge is released from side platens 182 and 183, it expands longitudinally until the bindings 207 become taut, thereby taking up the span 206 between the bindings 207 and forming a snug bale 204. For example, a 14"×18"×14" fully compressed charge of hay will typically expand longitudinally to 14"×18"×20" after release, lowering the density thereof from approximately 40 pounds per cubic foot before release to approximately 27 pounds per cubic foot after release. The period of time the charge remains between the side platens 182 and 183 after application of the bindings 207 allows the binding joints, typically heat-fused plastic, to cool and become fully bonded before releasing the bale.

The benefit of post-release expansion of the bale into the bindings can be illustrated as follows:

As shown in FIG. 1, the force required to achieve incremental increases in bale density increases approximately exponentially. If a charge of hay were bound in a fully compressed state at a density of 40 pounds per cubic foot, the total maximum amount of reactive force exerted on the bindings would be approximately 180,000 pounds, which may cause many binding materials to fail at a high rate. Allowing the fully compressed bale to expand into the bindings after release lowers the combined tension on the bindings to approximately 62,000 pounds or less, which is well within the capability of non-metallic bindings to withstand. In other words, the present invention overcompresses the charge so that, after binding and release, the charge is allowed to expand into the binding to the desired size and density while also greatly lowering the stress on the bindings. Consequently, bales of desired density and weight can be produced without significant failure of bindings and without the need to use metal wire or metal strapping.

Pumping and Control Means

All hydraulic cylinders in the present invention are actuated via hydraulic oil pumped under high pressure and controllably delivered, via solenoid valves and other control flow means, to each cylinder at predetermined times during the operational sequence. For example, referring to FIG. 10 for compressing hay or straw, the pump means 400 may include a pump 401, such as the Vickers Model 2520VQ double pump or equivalent, driven by a suitable motor 402, such as a diesel-type internal combustion engine generating 100 HP at 2,400 rpm, or by an electric motor having a similar rating.

Referring further to FIG. 10, the pump assembly 401 draws oil from an oil reservoir 403, which may have a capacity of 150 gallons for compressing hay or straw. The reservoir 403 may have an oil heater 404 to reduce oil viscosity in cold climates. The reservoir 403 may also have a small pump 405 driven by motor 406 (for example, one-third HP at five gallons per minute) for recirculating the oil during periods of non-use.

The hydraulic pump assembly 401 has two heads 407 and 408. For compressing hay or straw, the first head 407 may deliver 38 gallons per minute (gpm), the second head 408 may deliver 26 gpm. Both pump heads 407 and 408 pump oil to the hydraulic cylinders when the pump outlet pressure drops below approximately 2,000 psig. Such additional pumping capacity is important when pumping oil into large-volume cylinders encountering relatively low resistance in order to maintain an acceptably high pumping rate and save time during the compression cycle. If the outlet pressure exceeds approximately 2,000 psig, the output from the pump head 408 may be bypassed to the oil reservoir 403. A maximum pump outlet pressure of approximately 2,800 psig is governed by a regulator 409 downstream of pump head 407 that diverts oil flow to the reservoir 403 if the downstream pressure is excessive. Although the pressures given are preferred values for an apparatus according to the present invention intended for compressing hay or straw, other pressure values may be more appropriate for an apparatus according to the present invention intended for compressing other materials.

Timed extension and retraction of the hydraulic pistons are controlled by a control means comprised of electrically actuated solenoid valves, each of which may be controlled by a conventional programmable controller or by standard relay logic such as in the system shown in FIGS. 10 and 11A–C. In the system shown in FIGS. 10 and 11A–C, limit switches are mounted so as to be triggered when the hydraulic pistons are either extended or retracted. Specific logic combinations of limit-switch statuses (on or off) trigger the energization of particular control relays, the contacts of which add further logic status input for triggering other relays, solenoid valves, and signal lamps on one or more conventional graphic panels indicating the operational status of various components such as the hydraulic cylinders. Once a compression cycle is started, usually by a manually operated switch 286, the system will continue to operate automatically through successive cycles until turned off.

It is also possible to control the sequential movements of the hydraulic pistons using an electronic process controller, which may replace at least some of the limit switches and control relays.

It is also possible to provide, in addition to automatic controls as described above, manual activation of the individual hydraulic cylinders for limited-duty operation, trial runs, testing, emergencies, or other uses.

System Operation

FIGS. 11A, 11B and 11C show a typical control schematic depicting limit switches, control relays, and solenoid valves. Limit switches are mounted so as to be triggered when the precompression, compression, ejection, and load piston rods are either fully extended or fully retracted: limit switches 227 and 226 on the retracted and extended positions, respectively, of the compression piston rod 147; limit switches 231 and 230 on the retracted and extended positions, respectively, of the ejection piston rod 166; limit switches 234 and 235 on the retracted and extended positions, respectively, of the precompression piston rod 107; limit switches 232 and 233 on the retracted and extended positions, respectively, of the load piston rod 87; and limit switches 228 and 229 on the extended positions of the two dog cylinder piston rods 129 and 130, respectively.

In FIGS. 11A, 11B and 11C, each of the above limit switches is shown integrated into one or more numbered "rungs" of a parallel circuit controlling the extension and retraction of the loading means, precompression means, latching means, compression means, and ejection means. Additional rungs can be added to control the weighing means and binding means, as well as other functions such as a conveyer means and separating means, if included. Each rung of the circuit controls one or more solenoid valves, panel lights, or relay coils. Most rungs have one or more limit switches incorporated therein, each of which provides a logic input determining when the respective solenoid valve, panel light, and/or relay coil will be turned on or off during a compression cycle.

FIG. 10 is a schematic diagram showing the hydraulic interconnections of solenoid valves and other flow control components with their respective hydraulic cylinders and with the hydraulic pump assembly 401. Each solenoid valve controlling flow into the piston or rod ends of the corresponding hydraulic cylinder can be switched from a "neutral," or "N" position to either an "A" or "B" position, depending upon the desired direction of piston movement.

Referring to FIGS. 10, 11A, 11B and 11C, a typical compression cycle begins when the retracting precompression piston rod 107 triggers limit switch 234 at full retraction. When that happens, relay 236 is turned on which shifts solenoid valve 251 to the "B" position, routing pressurized oil to the rod end of the load cylinder 85, causing it to begin retracting. As the load piston rod 87 begins retracting, it begins pushing a fresh charge of material into the precompression chamber 61*b*. Also, limit switch 232 is triggered, which provides a logic input at rung 268, ensuring that the load piston rod 87 will extend back to the starting position later in the compression cycle when the ejection piston rod 166 begins to retract.

When the load piston rod 87 reaches full retraction, the charge is fully loaded into the compression chamber 61B. Also, limit switch 233 is triggered which returns solenoid valve 251 to the "N" position, shutting off oil pressure to the rod end of the load cylinder 85. Further, relay 237 is turned on which provides logic input to rungs 274 and 273 which control the extension of the precompression piston rod 107. When relay 237 turns on, solenoid valve 252 shifts to the "B" position, routing oil to the piston end of the precompression cylinder 105 and causing the precompression piston rod 107 to begin extending. Relay 236 is simultaneously turned off.

As the precompression piston rod 107 begins extending, it pushes the precompression platen 101 against the adjacent end of the loaded charge 98, pushing the charge toward and against the compression platen 141. Also, limit switch 234 is triggered, breaking the circuit at rungs 261 and 260. Limit switch 234 also provides logic input at rung 262, providing a condition for the retraction of the precompression piston rod 107 later in the cycle.

When the precompression piston rod 107 reaches full stroke, the charge has been pressed by the precompression platen 101 against the compression platen 141 and compressed to an intermediate length. For example, with an apparatus designed to compress hay or straw, the precompression cylinder 105 compresses the loaded charge, originally six to eight feet in length, to approximately 30 inches in length. Also, when the precompression piston rod 107 reaches full stroke, a number of electrical events occur. First, limit switch 235 is triggered, which turns relay 237 off, signalling solenoid valve 252 to return to the "N" position, shutting off pressurized oil flow to the piston end of the precompression cylinder 105. Limit switch 235 also, at rung 272, energizes relay 238 and shifts solenoid valve 253 to the "B" position. Solenoid valve 253 in the "B" position applies hydraulic pressure to the dog cylinders 125 and 126, activating dogs 121 and 122, respectively, to latch the precompression platen 101 in a stationary position. Relay 238 also energizes relay 239 which, at rung 270, shifts solenoid valve 254 to the "A" position, which routes pressurized oil to the piston end of the compression cylinder 145, causing the compression piston rod 147 to begin extending. Finally, full extension of the dogs 121 and 122 triggers limit switches 228 and 229, respectively, which turn relay 238 off, which returns solenoid valve 253 to the "N" position and shuts off hydraulic pressure to the dog cylinders 125 and 126. Limit switches 228 and 229 also provide logic input at rung 262 for the later retraction of the precompression piston rod 107.

As the compression piston rod 147 begins extending, the compression platen 141 compresses the partially compressed charge against the precompression platen 101 held stationary via the activated dogs 121 and 122 on the rear edges 111 and 112 thereof. Also, limit switch 227 is triggered which provides logic input at rung 263 for later release of the dogs 121 and 122.

When the compression piston rod 147 reaches full stroke, the charge is in a fully compressed state between the precompression platen 101 and compression platen 141. Also, limit switch 226 is triggered, shifting solenoid valve 254 to the "N" position, shutting off flow of pressurized oil to the piston side of the compression cylinder 145. Relay 239 is also turned off. Further, limit switch 226 turns relay 240 on at rung 269 and shifts solenoid valve 255 to the "B" position, routing pressurized oil to the piston end of the eject cylinder 163.

As the eject piston rod 166 begins to extend, the eject platen 162 is pressed against the fully compressed charge 161 to push it transversely out from between the precompression platen 101 and compression platen 141 to a first position 185 between side platens 182 and 183 (FIG. 8). Also, limit switch 231 is triggered which provides logic input at rung 270, satisfying one condition for later retraction of the eject piston rod 166.

When the eject piston rod 166 reaches full extension, the fully compressed charge 161 is completely expelled from space 167 (FIG. 8). Also, limit switch 230 is triggered, which turns off relay 240 and returns solenoid valve 255 to the "N" position, shutting off oil pressure to the piston side of the eject cylinder 163. A number of electrical events also occur. Limit switch 230 turns on relay 241 and shifts solenoid valve 256 from the "block" to the "flow" position, which will allow oil to flow from the rod end of the eject cylinder 163 to the piston end of the load cylinder 85 for subsequent retraction of the load piston rod 87. Relay 242 is turned on, which shifts solenoid valve 253 to the "A" position, retracting the dogs 121 and 122. Relay 242 also shifts solenoid valve 255 to the "A" position, which routes pressurized oil to the rod side of the eject cylinder 163 to begin retraction of the eject piston rod 166. Relay 242 also shifts solenoid valve 254 to the "B" position to route pressurized oil to the rod end of the compression cylinder 145 for retraction of the compression piston rod 147. Also, solenoid valves 257 and 258 shift from the "flow" to the "block" position, routing oil flow from the piston end of the compression cylinder 145 to the rod end of both the eject cylinder 163 and the precompression cylinder 105 and blocking oil flow to solenoid valve 255.

As a result of the above events, as the compression piston rod 147 retracts, oil from the piston side of the compression cylinder 145 is routed to the rod side of both the eject cylinder 163 and the precompression cylinder 105, causing their respective piston rods also to retract. As a result, the oil pump assembly 401 is relieved from having to pump oil into all three cylinders to effect retraction, thereby eliminating the need to pump large volumes of oil during retraction of these cylinders and appreciably saving cycle time. As the compression piston rod 147 retracts, the eject piston rod 166 retracts before the precompression piston rod 107 retracts, due to a lesser pressure drop from the compression cylinder 145 to the eject cylinder 163 than from the compression cylinder 145 to the precompression cylinder 105. The volume of oil on the piston side of the compression cylinder 145 is sufficient to retract both the eject and the precompression piston rods.

When the compression piston rod 147 is fully retracted, limit switch 227 is triggered, which shifts solenoid valve 254 to the "N" position, shutting off oil flow to the compression cylinder 145. Limit switch 227 also returns solenoid valves 257 and 258 to the "flow" positions. Also, when the compression piston rod 147 is fully retracted, the eject and compression piston rods are also fully retracted, which trigger limit switches 231 and 234, respectively. Limit switch 231 provides a logic input at rung 270 in preparation for the next cycle. Triggering of limit switch 234 initiates the next compression cycle. In addition, the load piston rod 87 has also returned to the fully extended position, triggering limit switch 233, which provides logic input at rung 260 for starting the next compression cycle.

The load, precompression, compression, dog and eject cylinders may also be operated manually via switches 246, 245, 249, 247, and 248, respectively. However, logic conditions dictated by respective limit switches and control relays must also be satisfied, as indicated in FIGS. 11A, 11B and 11C, which prevents the operator from accidentally damaging the cylinders and platens.

Referring further to FIG. 11A, other components of the present invention may be controlled as follows: Mains power is supplied by activating switch 286 (rung 279) which energizes relay 283. Switch 285 shuts off power to relay 283 to turn the system off. Switch 287 supplies ignition power to diesel engine 402, if that type of motor is used to drive hydraulic pump assembly 401. At rung 278 of FIG. 11A, limit switch 225 must be activated, and switches 288 and 289 closed, to operate oil recirculation pump motor 406 and oil heater 404. As shown in FIG. 10, limit switch 225 is activated when bypass valve 410 is turned to position 412 during heating of the oil and when starting pump motor 42. At rung 277, the circuit may be switched to an automatic mode by closing switches 290 and 291, which energize relay 282. Relay 282 completes a circuit pathway at rung 274 (FIG. 11B) necessary for continuous operation of successive compression cycles. If desired, the entire system may be reset to a starting condition by pressing switch 292 at rung 276, which energizes relay 281, providing appropriate logic inputs at rungs 277 and 266. Finally, the binding apparatus may be turned on by closing switch 294, which energizes relay 280.

Alternative Embodiment of Preload Means

Figure 4:
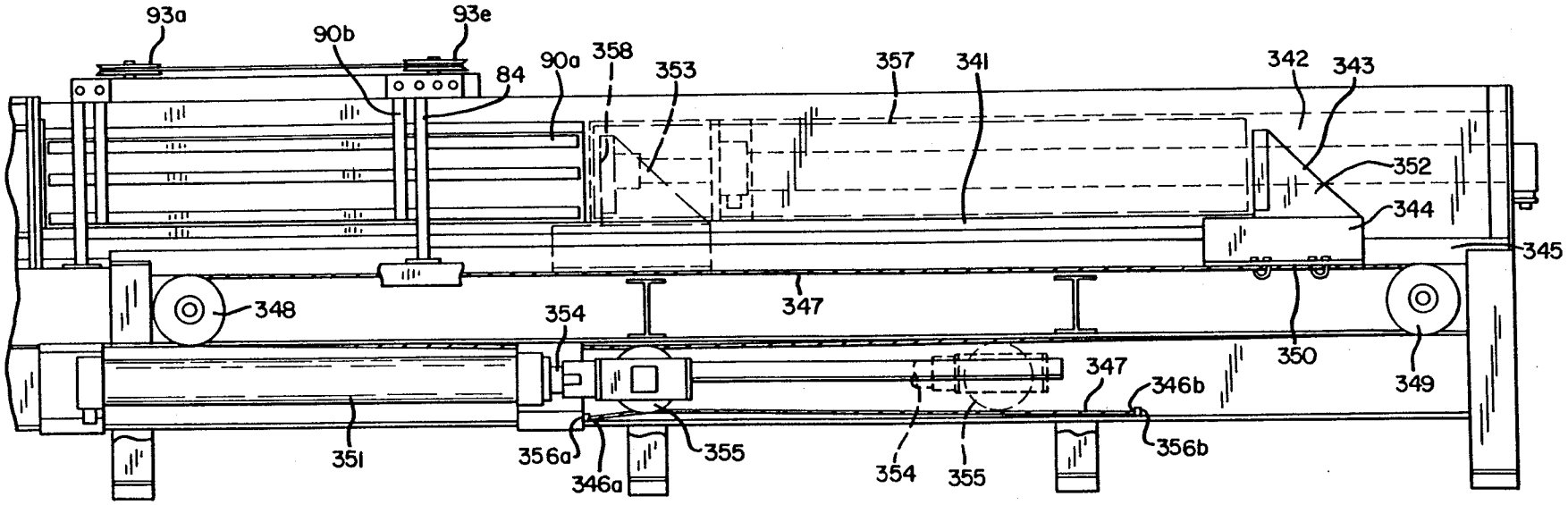
FIG. 4 is a front elevational view of an alternative embodiment of the preloading means, which performs a "preload compaction" of the charge of material before loading it into the precompression chamber.

In an alternative embodiment as shown in FIG. 4, the preload platen 43 not only serves to move a fresh charge into position for loading, but also applies a "preload compaction" force to the charge. Such an embodiment is particularly useful for loading material that had not previously been baled, such as hay from a drying apparatus, where the density of the stream of material is particularly low. Because more force is required to perform "compaction" compared to merely moving material on a platform, a separate preload hydraulic cylinder 344 is employed, the piston rod 347 of which is either linked directly to the preload platen 343 (linkage not shown) or terminates with a double sheave 355 linked to the preload platen 343 via a cable and sheave mechanism. The cable and sheave mechanism enables the preload platen 343 to move horizontally a distance approximately twice that of the preload piston stroke, thereby conserving hydraulic oil with a preload cylinder having a shorter stroke than a preload cylinder having a piston linked directly to the preload platen. With the cable and sheave mechanism, the preload piston rod 354 drives the preload platen 343 via double sheave 355, single sheaves 348 and 349, and a metal wire cable 347. The double sheave 355 is rotatably affixed to the end of the piston rod 354. The single sheaves 348 and 349 are rotatably affixed to the frame 311. The ends of the cable 346*a* and 346*b* are affixed to the frame 311 by anchors 356*a* and 356*b*. The cable 347 is attached at near midlength 350 to the preload platen 343 which slides reciprocally on bearing 344 along horizontal rail 345. Because the cable and sheave mechanism "doubles" the stroke of the preload piston, whenever the preload piston rod 354 strokes one foot in one direction, for example, the preload platen 343 moves two feet in the opposite direction. In preparation for loading, the preload platen 343 moves a charge of material 357 on preload platform 341 toward vertical platen 381. After the leading edge 358 of charge 357 contacts vertical platen 381, the preload platen 343 continues to move a preselected distance toward vertical platen 381, thereby longitudinally compacting the charge a predetermined amount before loading is commenced.

Having illustrated and described the principles of the invention in a principal and several alternative embodiments, it should be apparent to those skilled in the art that the invention may be modified in arrangement and detail without departing from such principles. We claim as our invention all modifications coming within the spirit and scope of the following claims.

We claim:

1. A method for compressing fibrous material into dense bales substantially uniform in size, shape and weight, the method comprising:

providing a charge of said fibrous material having a preselected mass;

arranging the charge into a rectangular elongated shape having a predetermined cross sectional configuration;

compressing the charge longitudinally in a first direction from one end thereof to a predetermined first length to form a partially compacted bale;

without otherwise moving said partially compacted bale, further comprising the same lengthwise from the end opposite said one end thereof in a second direction opposite to the first direction to form a fully compacted bale of a predetermined second length;

and applying binding material lengthwise around the charge while said fully compacted bale is maintained at the second length.

2. The method of claim 1 wherein the binding material is applied sufficiently loose to permit the resulting bale subsequently to expand a predetermined amount into the binding after release of the compressed charge; and the charge is thereafter released whereby it may expand lengthwise to the extent permitted by said binding material.

3. The method of claim 1 wherein said cross-sectional configuration has a transverse dimensional profile substantially identical to a desired transverse dimensional profile of said dense bale after compression.

4. The method of claim 1 wherein the fibrous material charge comprises fibers that are arranged to an orientation substantially perpendicular to the first and second direction of compression.

5. The method of claim 1 wherein the compression applied to the charge from the first direction is of a lesser magnitude and longer stroke than the subsequent compression from the second direction.

6. A method for compressing fibrous material into dense bales substantially uniform in size, shape, and weight, the method comprising:

providing a preselected mass of fibrous material;

loading the preselected mass of material into a compression chamber extending along a fixed longitudinal axis and having first and second opposing end platens transverse to and movable along the axis;

axially compressing the mass in the compression chamber a first amount by applying an axial force of relatively low magnitude to the first end platen against the mass toward the second end platen while maintaining the latter stationary;

latching the first end platen in a stationary position after it has moved a predetermined distance toward said second end platen;

compressing the mass in the compression chamber a second amount by applying an axial force of relatively high magnitude to the second end platen against the mass toward the stationary first end platen, thereby yielding a fully compressed mass of fibrous material between the first and second end platens;

pushing the fully compressed mass transversely out of the compression chamber to a position between two opposing fixed platens that maintain the mass in a longitudinally fully compressed state;

applying binding material circumferentially lengthwise around the fully compressed mass while it is held between the opposing fixed platens, the binding material being applied with a predetermined degree of looseness;

further transversely pushing a first bound and fully compressed mass until it is released from the opposing fixed platens, such pushing effected by subsequent fully compressed masses being transversely expelled from the compression chamber between the opposing fixed platens, the released mass longitudinally expanding against the binding material after release to form a completed bale, the degree of expansion determined by the previous looseness of the applied binding material.

7. The method of claim 6 wherein the fibrous material to be compressed has been arranged beforehand into a longitudinally extended low-density continuous stream of low-density unbound masses having a transverse dimensional profile substantially identical to a desired transverse dimensional profile of a high-density bale after compression.

8. The method of claim 7 wherein the fibrous material comprises fibers with axes that are substantially perpendicular to the longitudinal axis of the low-density stream.

9. An apparatus for compressing longitudinally extended, low-density charges of fibrous material along the longitudinal axis into dense bales substantially uniform in size, shape, and weight, the apparatus comprising:

a frame;

means on said frame defining a compression chamber for receiving a predetermined mass of said fibrous material, said chamber extending along a fixed longitudinal axis and being defined by sidewalls and first and second platens movable along said axis;

first compression means mounted on said frame and attached to and extending coaxially from said first movable platen of the compression chamber for axially precompressing a loaded charge of material a predetermined distance toward and against said second platen;

a latching means movable into and out of engagement with said first platen for holding said first platen in fixed position after the first compression means has compressed the charge said predetermined distance;

a second compression means mounted on said frame and attached to and extending coaxially from said second platen for axially compressing the precompressed charge against said first platen, after the same is latched in said fixed position, to a longitudinally fully compressed predetermined length;

and ejection means mounted on said frame for expelling a fully compressed charge transversely out of the compression chamber while said first and second platens are spaced apart said predetermined length.

10. An apparatus as set forth in claim 9 including a pair of fixed platen means for temporarily maintaining charges ejected out of the compression chamber in a fully compressed state for binding;

and means for wrapping binding material circumferentially lengthwise around the fully compressed charge sufficiently loose to permit the resulting bale to subsequently axially expand a predetermined amount into the binding after release of the bale from the fixed platen means.

11. The apparatus of claim 10 wherein the ejection means pushes the fully compressed charge transversely out of the compression chamber to a lateral position between said two fixed platens.

12. The apparatus of claim 11 wherein bound, high-density bales are pushed from between the two fixed platens by subsequently ejected fully compressed charges pushing from behind.

13. The apparatus of claim 9 wherein the interior of the compression chamber has a transversely dimensional profile substantially identical to the desired transverse dimensional profile of a fully compressed bale.

14. The apparatus of claim 9 including loading means for moving a preselected mass of materials into said chamber and means for activating the loading means when the first and second platens of the compression chamber are fully retracted apart from each other.

15. The apparatus of claim 14 including means responsive to activation of the ejection means to trigger movement of the loading means to a position ready to move a next mass of fibrous material into the compression chamber.

16. The apparatus of claim 14 including a receiving means for receiving a predetermined mass of fibrous material and a preload means for transferring the mass of fibrous material from said receiving means to said loading means.

17. The apparatus of claim 14 including a preload means for receiving an elongate mass of loose fibrous material and longitudinally compressing the mass a predetermined amount and positioning the mass for movement by the loading means into the compression chamber.

18. The apparatus of claim 9 including means for activating the first compression means after a loading means has transferred a charge of material into the compression chamber.

19. The apparatus of claim 9 wherein the latching means is compressed of pivotally mounted dogs.

20. The apparatus of claim 9 including means to activate the second compression means when the first platen of the compression chamber is latched into said fixed position.

21. The apparatus of claim 9 wherein the first compression means has a longer stroke but applies a lower magnitude force to a loaded charge than the second compression means.

22. The apparatus of claim 9 including means for activating the ejection means after the first and second compression means have fully compressed a loaded charge.

23. The apparatus of claim 9 including means responsive to the movement of the ejection means to eject a fully compressed charge to activate retraction of the second compression means.

24. The apparatus of claim 9 wherein the first and second compression means and the ejection means are hydraulic cylinders each with a piston rod.

25. The apparatus of claim 14 wherein the first and second compression means hydraulic cylinders are axially aligned with the compression chamber, and each of said first and second compression means hydraulic cylinders has a piston rod for carrying said first and second platens, respectively, on an end thereof.

26. The apparatus of claim 24 wherein the first compression means hydraulic cylinder has a smaller diameter and longer piston than the diameter and piston stroke, respectively, of the second compression means.

27. The apparatus of claim 24 wherein said piston rod of the ejection means supports an eject platen oriented parallel to the compression chamber axis, and means for causing the ejection piston rod to move the eject platen in a direction substantially transverse to the compression chamber longitudinal axis, after the second compression means has fully compacted a charge, to push the fully compressed charge transversely out of the compression chamber.

28. The apparatus of claim 24 including means, as the second compression means hydraulic piston retracts, for routing the hydraulic oil on the piston side of the second compression means cylinder to the rod side of both the ejection hydraulic cylinder and the first compression means hydraulic cylinder, whereby to cause the piston rods of both the ejection and first compression hydraulic cylinders also to retract, thereby lessening the volume of oil that must be pumped to effect such retraction, shortening a cycle time and reducing energy required for a compressing process.

29. The apparatus of claim 9 wherein the interior walls of the compression chamber include means for attaching removable solid sheet material thereto, thereby permitting the transverse dimensional profile of the compression chamber to be changed.

30. The apparatus of claim 9 including means to effect retraction of the first and second compression means after the ejection means has ejected a compressed charge from between said platens.

* * * * *